US006033500A

United States Patent [19]

Ito et al.

[11] Patent Number: 6,033,500

[45] Date of Patent: Mar. 7, 2000

[54] AIRBAG EXPLOSIVE COMPOSITION AND PROCESS FOR PRODUCING SAID COMPOSITION

[75] Inventors: Yuji Ito, Tokyo; Eishi Sato, Himeji; Akihiko Tanaka, Himeji; Makoto Iwasaki, Himeji; Kenjiro Ikeda; Eri Oishi, both of Asa-gun; Ryo Minoguchi, Himeji; Eiichiro Yoshikawa, Himeji; Akihiko Kuroiwa, Himeji, all of Japan

[73] Assignees: Sensor Technology Co., Ltd., Kobe; Nippon Kayaku Kabushiki-Kaisha, Yokyo, both of Japan

[21] Appl. No.: 08/983,507

[22] PCT Filed: Jul. 25, 1996

[86] PCT No.: PCT/JP96/02102

§ 371 Date: Jan. 27, 1998

§ 102(e) Date: Jan. 27, 1998

[87] PCT Pub. No.: WO97/05087

PCT Pub. Date: Feb. 13, 1997

[30] Foreign Application Priority Data

| | | | |
|---|---|---|---|
| Jul. 27, 1995 | [JP] | Japan | 7-212352 |
| Aug. 25, 1995 | [JP] | Japan | 7-239069 |
| Nov. 30, 1995 | [JP] | Japan | 7-337815 |

[51] Int. Cl.[7] ..... C06B 31/28; C06B 21/00

[52] U.S. Cl. ..... 149/36; 149/46; 149/61; 149/77; 149/109.4; 149/109.6; 149/17; 264/3.1

[58] Field of Search ..... 149/36, 46, 61, 149/109.6, 109.4, 77, 17; 264/3.1

[56] References Cited

U.S. PATENT DOCUMENTS

| | | | |
|---|---|---|---|
| 5,035,757 | 7/1991 | Poole | 149/61 |
| 5,139,588 | 8/1992 | Poole | 149/61 |
| 5,386,775 | 2/1995 | Poole et al. | 149/36 |
| 5,472,535 | 12/1995 | Mendenhall et al. | 149/36 |
| 5,514,230 | 5/1996 | Khandhadia | 149/36 |
| 5,518,054 | 5/1996 | Mitson et al. | 149/35 |
| 5,765,866 | 6/1998 | Canterberry et al. | 280/741 |

*Primary Examiner*—Edward A. Miller

*Attorney, Agent, or Firm*—Oblon, Spivak, McClelland, Maier & Neustadt, P.C.

[57] ABSTRACT

The present invention is directed to an airbag explosive composition comprising a fuel ingredient, an oxidizing agent and a binder for binding them, said binder being hydrotalcite group expressed by the following general formula (1), and a producing method therefor:

$$[M^{2+}_{1-x}M^{3+}_{x}(OH)_2]^{x+}[A^{n-}_{x/n}\cdot mH_2O]^{x-} \quad (1)$$

where $M^{2+}$ represents a bivalent metal such as $Mg^{2+}$, $Mn^{2+}$, $Fe^{2+}$, $Co^{2+}$, $Ni^{2+}$, $Cu^{2+}$ and $Zn^{2+}$;

$M^{3+}$ represents a trivalent metal such as $Al^{3+}$, $Fe^{3+}$, $Cr^{3+}$, $Co^{3+}$ and $In^{3+}$;

$A^{n-}$ represents an n-valence anion such as $OH^-$, $F^-$, $Cl^-$, $NO_3^-$, $C0_3^{2-}$, $SO_4^{2-}$, $Fe(CN)_6^{3-}$, $CH_3COO^-$, oxalate ion and salicylate ion; and $0<x\leqq 0.33$.

33 Claims, 2 Drawing Sheets

AIRBAG EXPLOSIVE COMPOSITION AND PROCESS FOR PRODUCING SAID COMPOSITION

TECHNICAL FIELD

The present invention relates to an explosive composition available for a gas generating agent or an enhancer (a transfer charge) for an airbag for occupant restraint system in a vehicle and a producing method therefor. More particularly, the present invention relates to an airbag explosive composition easy to control a combustion velocity, able to be safely produced, excellent in thermal shock resistance and strength of the produced tablet and capable of producing a clean gas from the combustion, and the producing method therefor.

BACKGROUND ART

An airbag system, which is occupant restraint system, has been widely adopted in recent years for improving safety of the occupants in a vehicle. The airbag system operates on the principle that a gas generator is operated under control of signals from a sensor detecting a collision, to inflate an airbag between occupant and a car body. The gas generator is required to have a function to produce a required and sufficient amount of clean gas containing no harmful gas in a short time. On the other hand, the gas generating agent is press-formed into a tablet form for stability to the combustion, and the transfer charge is formed into a granule form for use. The tablets and granules are required to maintain their initial combustion characteristics over a long time even under various harsh environments. In the event that the tablets deforms or decreases in strength due to deterioration with age, change of environments and the like, the combustibility of the explosive composition will exhibit at an abnormally earlier time than the initial combustibility, so there is a fear that the airbag or the gas generator itself may be broken with the abnormal combustion in case of a collision, to fail in accomplishing the aim of protecting the occupants or even cause them injury.

To satisfy those required functions, gas generating agents containing metallic compound azide such as sodium azide and potassium azide as their major ingredient have been used hitherto. These known gas generating agents are widely used in terms of their advantages that they are burnt momentarily; that the ingredient of combustion gas is substantially nitrogen gas only, so that no harmful gas such as CO (carbon monoxide) or NOx (Nitrogen oxide) is produced; and that since the combustion velocity is little influenced by the environment or the structure of the gas generator, it is easy to design the gas generator. However, these known gas generating agents have a disadvantage to be readily exploded by impact and friction, so it is difficult to make them explosion-proof, as demonstrated by large and small explosion accidents happened here and there in the manufacturing process. Further, the known gas generating agents have a notable disadvantage that they decompose in the presence of water and acid then produce a harmful gas. Due to this, it comes to be urgently necessary these days to develop a safer gas generating agent and put it into practical use, in substitution for the known gas generating agents whose major ingredient is the metallic compound azide.

On the other hand, the method in which tetrazoles including amino tetrazole are mixed with and used in combination with the metallic compound azide has been proposed in, for example, Japanese Laid-open Patent Publications No. Sho 49(1974)-87583, No. Hei 2(1990)-184590 and No. Hei 2(1990)-221179. Since molecules of the tetrazoles have a high proportion of atoms of nitrogen such that production of CO can be suppressed, almost no CO is produced in the combustion gas, as in the case with the metallic compound azide. Besides, the tetrazoles are superior to the above said metallic compound azide in far less danger and toxicity. The gas generating agent of this type comprising the mixture of the tetrazoles with the metallic compound azide succeeded in lessening the problems involved in the gas generating agent containing the metallic compound azide as its major ingredient, as compared with the one singly using the metallic compound azide, but has not yet succeeded in solving the above said problems fundamentally, as long as its using the metallic compound azide.

Accordingly, in order to make the best use of the advantages of the tetrazoles, a modified method using tetrazoles singly rather than in combination with the metallic compound azide was proposed, as disclosed in, for example, Japanese Patent Publications No. Sho 64(1989)-6156 and No. Sho 64(1989)-6157 and Japanese Laid-open Patent Publications No. Hei 2(1990)-225159, No. Hei 2(1990)-225389, No. Hei 3(1991)-20888, No. Hei 5(1993)-213687, No. Hei 6(1994)-80492, No. Hei 6(1994)-239684 and No. Hei 6(1994)-298587. The method using the tetrazoles containing no hydrogen (JP Patent Publications No. Sho 64(1989)-6156 and No. Sho 64(1989)-6157 and JP Laid-open Patent Publications No. Hei 6(1994)-80492 and No. Hei 6(1994)-239684) is, in particular, superior in that moisture is not contained In the produced gas. The moisture may condense in the airbag to sharply decrease the volume. However, this method has a disadvantage that the tetrazoles themselves were low in combustibility, so that the tetrazoles used as the gas generating agent often interrupted the combustion then hinder the complete combustion of the gas generating agent.

Accordingly, for improvement of the combustibility, a retrospective method of a combined use of the tetrazoles and the metallic compound azide (the above said JP Laid-open Patent Publication No. Hei 2(1990)-221179) and a method using a powerful oxidizing agent such as chlorate or perchlorate (the above said JP Laid-open Patent Publication No. Hei 6(1994)-298587) were proposed. However, the former had the above said safety problem inherent in the metallic compound azide, while the latter had the problem that despite of using tetrazoles of higher level of safety, the safety is resultantly reduced by the use of the powerful oxidizing agent. In addition, when chlorate or perchlorate was used as the oxidizing agent, there are another problem that combustion temperature rose and resultantly NOx was generated.

The generation of NOx may be restrained by using low-combustibility nitrates or nitrites as the oxidizing agent, but in this case, since the nitrate and nitrite have the property of absorbing heat then decompose during the reaction of the oxidizing agent with the tetrazoles, their inherent drawbacks of poor ignitability and slow combustion velocity are amplified, so that the above said grave problem, that the gas generating agent once ignited cannot lead to a complete combustion, remains still unsolved.

Further, in the system using a powerful oxidizing agent such as chlorate or perchlorate, there was presented a serious drawback that a pressure exponent of combustion reaction is so high that the combustion must be controlled with difficulties.

Specifically, the relation between the combustion velocity (dW/dt) and the pressure in combustion of explosive is expressed by the following formula:

$$dW/dt=A\cdot P^{n} \quad \text{Formula (5)}$$

where W represents an explosive combustion amount (g), t represents time (second), A represents a constant by the system, P represents a pressure (atm), and n represents a pressure exponent (a constant by the system).

On the other hand, the relation between the velocity (dWG/dt) for discharging the gas from the gas generator and the pressure is expressed by the following formula:

$$dW_G/dt=K\cdot P^{0.5} \quad \text{Formula (6)}$$

where WG represents an amount (g) of discharging the gas from the gas generator, t represents time (second), K represents a constant by the system, and P represents a pressure (atm.).

It is understood from the formulas (5) and (6) that since the combustion velocity of the gas generating agent is proportional to the power of nth of the pressure P and the velocity of discharging the gas from the gas generator is proportional to the power of 0.5th of the pressure P, if the pressure exponent n is more than 0.5, the combustion amount becomes more than the amount of discharging the gas from the gas generator, so that the pressure in the gas generator comes to rise gradually. Here, if the pressure exponent n is remarkably large, the pressure in the gas generator will rise sharply to cause the combustion velocity to increase more and in turn cause the pressure in the gas generator to rise more and more, which will eventually cause an explosion of the container. The above said method using a powerful oxidizing agent such as chlorate or perchlorate (the above said JP Patent Laid-open Publication No. Hei 6(1994)-298587 and others) had the problem of the pressure exponent becoming too large to control the combustion. Further, it is known that the metallic compound azide allows an easily filterable slag to be formed by its combined use with silicon dioxide, but, disadvantageously, using the tetrazoles makes it difficult to form the easily filterable slag.

With these non-azide base gas generating agent compositions, the fuel ingredients are the above said organic compounds including the tetrazoles mentioned above, whereas the oxidizing agents are inorganic compounds including chlorate or perchlorate. Due to this, there arises a problem in formability of tablets and the like when a usual binder is used, so that the non-azide base gas generating agents formed into tablets and the like were rather inferior in mechanical strength to those of the azide base gas generating agents. Also, in the thermal shock tests in which environmental temperature around the tablets and the like are raised and fallen repeatedly, it was found that due to difference in coefficient of thermal expansion between the orgahic compound and the inorganic compound, the binding power of the binder decreased gradually, and there were some extreme cases where the forms deteriorated into powder. Accordingly, JP Laid-open Patent Publication No. Hei 6(1994)-219882 proposed that combustible polymers including polyurethane, cellulose acetate, hydroxy-terminated polybutadiene and ethyl cellulose are used as the binder. However, when these organic polymeric compounds are used, there arises a problem of increasing concentration of harmful carbon monoxide (CO) in the combustion gas together with a calorific value, which in turn arises the need for increasing an amount of a cooling material (a woven metal wire or equivalent) for cooling the generated gas. As a result, the gas generator increases in size and weight against the times' demands of reduction of size and weight of the system.

Also, what is called "a boron niter" having boron and potassium nitrate as its major ingredients is generally used as an enhancer charge for igniting the gas generating agent. However, no matter which of the metallic compound azides and the tetrazoles is used as the gas generating agent, since the boron niter is quite different from either of them in composition, the enhancer must be disadvantageously produced in a separate process independent of the production process of the gas generating agent.

The present invention aims to solve the above said problems involved in the known airbag explosive composition including the above-mentioned known gas generating agent and enhancer. Specifically, the present invention provides a novel airbag explosive composition capable of providing good formability even when the gas generating agent has organic nitrogen containing compound as its ingredient; good combustibility with solving the problems involved in the conventional type gas generating agents having the metallic compound azides or the tetrazoles as their major ingredient; high safety with the best possible use of the advantages of the tetrazoles; easy combustion controllability; and high in slag forming ability. In other words, the objects of the present invention are:

(1) to provide a novel binder which can provide good formability and properties in the presence of an inorganic oxidizing agent even if the fuel ingredients are the tetrazoles or other organic nitrogen containing compounds;

(2) to provide an explosive composition which is easy to handle and high in safety without generating any harmful gases;

(3) to provide an explosive composition which is low in pressure exponent or easy to control of the combustion, even in the combination of the tetrazoles and the powerful oxidizing agent such as chlorate or perchlorate;

(4) to provide a novel explosive composition which can provide improved combustibility to allow the complete combustion of the explosive composition, even in the combination of the tetrazoles and the oxidizing agent of poor combustibility such as nitrate or nitrite;

(5) to provide a novel explosive composition which can form an easily filterable slag to obtain a clean gas; and (6) to provide a novel explosive composition which is identical in composition to the gas generating agent and usable as the enhancer as well.

DISCLOSURE OF THE INVENTION

The present invention is directed to an airbag explosive composition comprising a fuel ingredient, an oxidizing agent and a binder for binding them, the binder being hydrotalcite group which is expressed by the following general formula (1), whereby good formability and stable properties resistant to environmental changes is maintained:

$$[M^{2+}_{1-x}M^{3+}_{x}(OH)_2]^{x+}[A^{n-}_{x/n}\cdot mH_2O]^{x-} \quad (1)$$

where $M^{2+}$ represents a bivalent metal such as $Mg^{2+}$, $Mn^{2+}$, $Fe^{2+}$, $Co^{2+}$, $Ni^{2+}$, $CU^{2+}$ and $Zn^{2+}$;

$M^{3+}$ represents a trivalent metal such as $A1^{3}+$, $Fe^{3+}$, $Cr^{3+}$, $Co^{3+}$ and $In^{3+}$;

$A^{n-}$ represents an n-valence anion such as $OH^-$, $F^-$, $Cl^-$, $NO_3^-$, $CO_3^{2-}$, $SO_4^{2-}$, $Fe(CN)_6^{3-}$, $CH_3COOH^-$, oxalate ion and salicylate ion; and $0<x\leqq 0.33$.

It is preferable that synthetic hydrotalcite (hereinafter it is simply referred to as "HTS") expressed by a chemical formula $Mg_6Al_2(OH)_{16}CO_3 \cdot 4H_2O$ or pyroaurite of $Mg_6Fe_2(OH)_{16}CO_3 \cdot 4H_2O$ is selected from the hydrotalcite group. The HTS or equivalent have the advantages of being readily available and also resistant to formation of harmful gases and slag components. Preferably, hydrotalcite amount is in the range of 2 to 30% by weight of the explosive composition, preferably, in the range of 3 to 10% by weight. In this range, an adequate amount of fuel ingredient and oxidizing agent is allowed to be contained. Further, it is preferable that a 50% average particle diameter of a reference number of the hydrotalcite is set to be 30 $\mu$m or less. This particle size allows the hydrotalcite to function as the binder for binding the fuel ingredient and the oxidizing agent ingredient satisfactorily.

Next, for the fuel ingredient for use in the explosive composition of the present invention, organic compounds containing nitrogen as a prime atom in the structural formula are preferable. Particularly, a preferable compound is or are one or more kinds selected from the group of the tetrazoles consisting of the following ① to ③:

① tetrazole group including one or more hydrogen atoms;

② aminotetrazole group other than ①; and

③ an alkali metal salt, an alkali earth metal salt or an ammonium salt of the above said ① or ②.

These tetrazole groups have the property of producing very little harmful CO gas in the combustion. Also, it is preferable that a 50% average particle diameter of a reference number of the compound in the tetrazole group is set to be 5 to 80 $\mu$m. This particle size allows the fuel ingredient to be uniformly distributed in the explosive composition, so that combustion adjustment is facilitated.

Next, for the oxidizing agent to be added to the explosive composition of the present invention, one or more kinds of nitrates or nitrites are preferable. The use of this oxidizing agent enables generation of harmful nitrogen oxides to be restrained. Further, an oxohalogen acid salt may be added to the oxidizing agent to improve ignitability of the tetrazoles. Also, it is preferable that a 50% average particle diameter of a reference number of the oxidizing agent is regulated to the range of 5 to 8 $\mu$m. In this range, an uniform mixture of the fuel ingredient and remaining ingredients can be easily accomplished to facilitate combustion adjustment.

Further, in addition to the above said fuel ingredient and oxidizing agent, a combustion catalyst selected from the group consisting of one or more kinds of the following ④ or ⑤ may be contained in the explosive composition of the present invention, to facilitate control of combustion:

④: one or more kinds of zirconium, hafnium, molybdenum, tungsten, manganese, nickel, iron or the oxide or sulfide; and ⑤: one or more kinds of carbon, sulfur or phosphorus.

Also, it is preferable that a 50% average particle diameter of a reference number of the combustion catalyst is regulated to a range of 10 $\mu$m or less. In this range, an uniform mixture of fuel ingredients and other ingredients can be easily accomplished to facilitate combustion adjustment.

Further, an example of the explosive composition of the present invention is one using the above said tetrazole as the fuel ingredient; the strontium nitrate as the oxidizing agent; and the hydrotalcite as the binder. This can produce the explosive composition having good formability, combustibility, slag scavenging property and prolonged stability. When the strontium nitrate is used as the oxidizing agent, the combustion catalyst is not necessarily needed to obtain good properties, differently from the case of using other nitrates, and as such is the specially notable combination.

When the above-described explosive composition is formed into a tablet-like shape or a disk-like shape, one or more kinds of water-soluble polymers selected from the group consisting of, for example, polyethylene glycol, polypropylene glycol, polyvinyl ether, polymaleic copolymers, polyethylene imine, polyvinyl alcohol, polyvinyl pyrrolidone, polyacrylamide, sodium polyacrylate and ammonium polyacrylate may be added as a formability adjustor to improve the formability. In particular, when the water-soluble polymer used is polyvinyl alcohol, the addition is preferably in the range of 0.01 to 0.5% by weight. Also, for forming the explosive composition into tablets, one or more kinds of lubricants selected from the group consisting of, for example, stearic acid, zinc stearate, magnesium stearate, calsium stearate, aluminum stearate, molybdenum disulfide, graphite, atomized silica and boron nitride, may be added to improve the formability.

Also, when the fuel ingredient and the oxidizing agents are pulverized to the desired particle diameter, a small amount of lubricant, which acts as a consolidation inhibitor, may be added for effective pulverization. Among the above said lubricants it is particularly preferable to apply the atomized silica, and preferably a 0.1 to 2.0 weight % lubricant relative to the fuel ingredient or the oxidizing agent is added for the pulverization work.

Further, the explosive composition of the present invention may be formed into a tablet or disk-like form so as to be used as the gas generating agent or may be formed into a granular form of a diameter of not more than 1.0 mm so as to be used as the enhancer.

Next, the producing method for the explosive composition of the present invention comprises the steps: that a tetrazole, an oxidizing agent and a hydrotalcite used as a binder are mixed, with selectively adding thereto a combustion catalyst, a modifier of a formability or a lubricant; that the mixture is formed into a given shape; and that the formed mixture is heat-treated at 100 to 120° C. for 2 to 24 hours, to thereby produce the explosive composition having good heat resistance. This can produce an explosive composition excellent in heat resistance. In this case also, hydrotalcite expressed by a chemical formula $Mg_6Al_2(OH)_{16}CO_3 \cdot 4H_2O$ or pyroaurite expressed by a chemical formula $Mg_6Fe_2(OH)_{16}CO_3 \cdot 4H_2O$ is preferably used as the hydrotalcite, as described above. Further, it is preferable that a 50% average particle diameter of a reference number of the tetrazoles used is 5 to 80 $\mu$m; a 50% average particle diameter of a reference number of the oxidizing agent used is 5 to 80 $\mu$m; a 50% average particle diameter of a reference number of the binder used is not more than 30 $\mu$m; and a 50% average particle diameter of a reference number of the combustion catalyst used is not more than 10 $\mu$m.

BEST MODE FOR CARRYING OUT THE INVENTION

Figure 1:
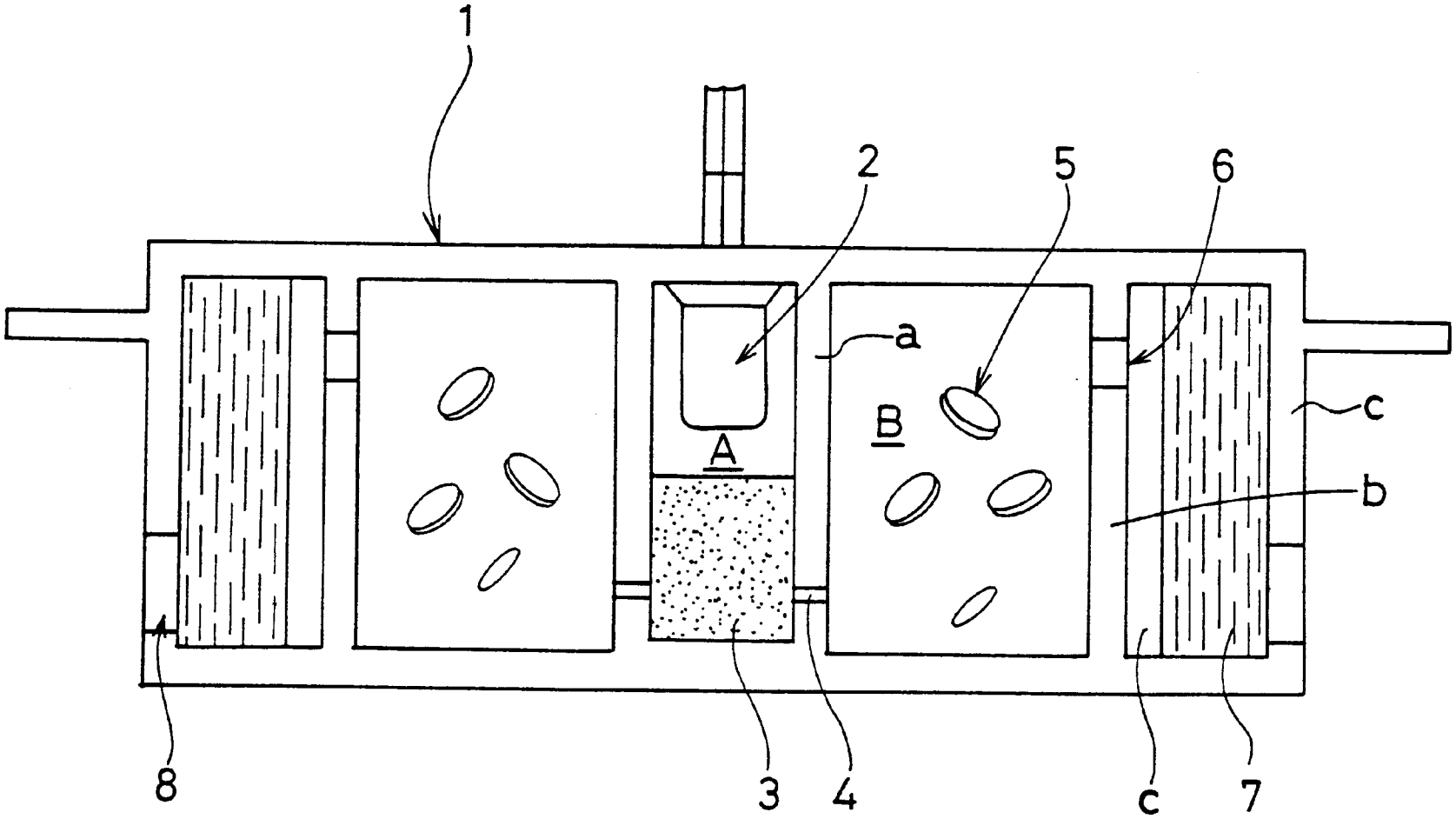
FIG. 1 is a conceptual view of a gas generator used in examples of the present invention.

The detailed description of the contents of the present invention is given below. First, the hydrotalcites used as a binder for an airbag explosive composition of the present invention is a compound expressed by the following general formula (1), as described in Gypsum & Lime No. 187 (1983), pages 47–53:

$$[M^{2+}_{1-x}M^{3+}_{x}(OH)_2]^{x+}[A^{n-}_{x/n}.m\ H_2O]^{x-} \quad (1)$$

where $M^{2+}$ represents a bivalent metal such as $Mg^{2+}$, $Mn^{2+}$, $Fe^{2+}$, $Co^{2+}$, $Ni^{2+}$, $Cu^{2+}$ and $Zn^{2+}$;

$M^{3+}$ represents a trivalent metal such as $Al^{3+}$, $Fe^{3+}$, $Cr^{3+}$, $Co^{3+}$ and $In^{3+}$; $A^{n-}$ represents an n-valence anion such as $OH^-$, $F^-$, $Cl^-$, $NO_3^-$, $CO_3^{2-}$, $SO_4^{2-}$, $Fe(CN)_6^{3-}$, $CH_3COO^-$, oxalate ion and salicylate ion; and $0<x\leqq 0.33$.

The hydrotalcite, which is a material used as an antacid, is a porous material having water of crystallization. The inventors discovered that hydrotalcite is very useful as a binder for gas generating agent of organic non-azide base compounds and accomplished the present invention. The explosive composition containing the hydrotalcite as the binder can obtain a degree of hardness (25–30 Kg) much higher than a degree of hardness of tablet of 10–15 Kg (Monsant type hardness meter) of a general type of azide base gas generating agent even in a low tabletization pressure, especially when applied to non-azide base gas generating agent composition having the tetrazole as its major ingredient, as will be described later. This is attributed to the hydrotalcite liable to absorb moisture, and as such can act to bind the respective ingredients of the explosive composition firmly. The tablet produced by us e of this binder keeps its characteristic and combustion characteristic unchanged against the thermal shock caused by temperature being raised and fallen repeatedly, thus enabling the tablet to be minimized in deterioration with age after practical installation on a vehicle, to be stable in formability.

Typical of hydrotalcite is the synthetic hydrotalcite (HTS) expressed by the chemical formula $Mg_6Al_2(OH)_{16}CO_3.4H_2O$ or the pyroaurite expressed by the chemical formula $Mg_6Fe_2(OH)_{16}CO_3.4H_2O$. The synthetic hydrotalcite is preferable in terms of availability and costs.

Further, the hydrotalcite produces no harmful gas during the combustion of either of the gas generating agent and the enhancer. In the example of hydrotalcite, this is presumably due to occurrence of the reaction as shown in the following formula (2). In this case, the reaction itself is an endothermic reaction, and as such can provide an advantageous effect of reducing a heat release value of the gas generating agent.

$$Mg_6Al_2(OH)_{16}CO_3.4H_2O \rightarrow 6MgO+Al_2O_3+CO_2+12H_2O \quad \text{Formula (2)}$$

Further, the MgO and $Al_2O_3$ obtained by the decomposition reaction are high-melting oxides, and alkali metal oxide (e.g. $K_2O$) contained in the oxidizing agent of the explosive composition and the $Al_2O_3$ produced by the decomposition of the hydrotalcite are thought to be allowed to react with each other as shown in the following formula (3), to form a slag as a glassy aluminum potassium oxide which is easily filtered with a filter.

$$K_2O+Al_2O_3 \rightarrow K_2Al_2O_4 \quad \text{Formula (3)}$$

Also, the decomposition product itself of the hydrotalcite is also thought to be allowed to form an easily filterable aluminum magnesium oxide by slag reaction which is an acid-base reaction shown in the following formula (4).

$$MgO+Al_2O_3 \rightarrow MgAl_2O_4 \quad \text{Formula (4)}$$

This binder is in general added in the range of 2 to 30% by weight in the explosive composition. This is because a not more than 2% binder has difficulties in serving as the binder, while a not less than 30% binder causes reduction of an adding amount of other ingredients then leads to difficulties in serving as the explosive composition. It is particularly preferable to add the binder in the range of 3 to 10%.

The particle diameter of the binder is also of essential for production technique. According to the present invention, a 50% average particle diameter of a reference number of the binder is preferably set to be not more than 30 $\mu$m. The particle size larger than that will weaken the binder's function of binding the above said ingredients then make it difficult to expect the activity as the binder, thus there being a fear that a specified strength of the form cannot be obtained.

It is noted here that the 50% average particle diameter of a reference number is measured on the basis of a distribution of the particle diameter. In the distribution, the total number of particles is set to be 100 and the numbers of particles corresponding to each particle diameter are plotted. The particle diameter at a reaching point in the distribution of the particle diameter is regarded as the 50% average particle diameter of a reference number. The reaching point is the point where the number of particles reaches 50 to be summed up from a side of the smaller particle diameter till reaching to 50 number of particles.

Next, an organic compound including the nitrogen as a constitutional atom is used as a fuel ingredient in the explosive composition of the present invention. For the organic compound including the nitrogen as a constitutional atom (hereinafter it is referred to as organic nitrogen containing compound), any organic compound which is combustible and also has a high proportion of nitrogen atom may be used. For instance, compounds included in the following tetrazole groups may be used.

①: tetrazole group including one or more hydrogen atoms;

②: aminotetrazole group other than ①; and

③: an alkali metal salt, an alkali earth metal salt or an ammonium salt of these tetrazole groups The tetrazole groups includes, for example, tetrazole, aminotetrazole, triazole, bitetrazole, guanidine, aminoguanidine, triaminoguanidine nitrate, nitroguanidine, azobiguanidine, carbonamide, azodicarbonamide, hydrazocarbonamide, hydrazine, formylhydrazine, formamidine, monoethylhydrazine, carbohydrazine, dicyandiamido and hydrazide oxalate or salts thereof.

These tetrazoles used in the present invention, which are known compounds, have a high proportion of an atom of nitrogen in the molecular structure, so they basically have the structure of restraining production of the harmful CO gas, as described above, and also have various advantages, e.g. higher handling safety, as compared with the metallic compound azide. ① As the above said tetrazole group including one or more hydrogen atoms, there are, for example, 1H-tetrazole, 5,5-bis-1H-tetrazole, 1-methyl-1H-tetrazole, 5-methyl-1H-tetrazole, 1,5-dimethyl-1H-tetrazole, 1-ethyl-5-methyl-1H-tetrazole, 5-mercapto-1H-tetrazole, 1-methyl-5-mercapto-1H-tetrazole, 1-ethyl-5-mercapto-1H-tetrazole, 1-carboxymethyl-5-mercapto-1H-tetrazole, 1-phenyl-5-mercapto-1H-tetrazole, 1-(4-hydrophenyl)-5-mercapto-1H-tetrazole, 5-phenyl-1-tetrazole and 1-ethyl-5-hydroxy-1-tetrazole, which are in general commercially available. And ② as aminotetrazoles other than the above-listed ones, there are, for example, 5-amino-1H-tetrazole, 1-(3-acetamidephenyl)-5-mercapto-1H-tetrazole and 1-N, N-dimethylaminoethyl-5-mercapto-1H-tetrazole, which are also commercially available. One or more kinds of these or one or more kinds selected from an alkali metal salt, an alkali earth metal salt or an ammonium salt are used. Particularly preferable among them is 5-amino-lH-tetrazole or its salt in terms of nitrogen highly contained in the molecule, substantially large amounts available with a low-price.

For use of the compounds in the tetrazole group, the particle diameter is preferably regulated in advance by pulverizing after a small amount of lubricant (e.g. atomized silica) having a capability of preventing consolidation is added thereto. In the case of the present invention, the 50% average particle diameter of a reference number of the compound in the tetrazole group is regulated to be 5–80 $\mu$m. The particle of the compound in the tetrazole group, which is pulverized into a less diameter than the above said diameter 5 $\mu$m will allow the combustion velocity to increase excessively in an airbag gas generator then lead a possibility of exploding the gas generator. On the other hand, the particle of the the compound in the tetrazole group, which is pulverized so as to have a larger particle diameter than the above said diameter 80 $\mu$m, will allow the combustion velocity to decrease excessively then lead little availability for employing to the airbag.

Next, for the oxidizing agent for allowing the fuel to burn, nitrates, nitrites or salts of oxohalogen acid may be used. As the nitrates, an ammonium salt and a nitrate of alkali metal or alkali earth metal are instanced. Specifically, sodium nitrate, potassium nitrate, barium nitrate, strontium nitrate and ammonium nitrate are examples of the nitrates. As the nitrites, an ammonium salt and a nitrite of alkali metal or alkali earth metal are instanced. Specifically, sodium nitrite, potassium nitrite, barium nitrite, strontium nitrite and ammonium nitrite are examples of the nitrites. As the salts of oxohalogen acid, ohlorates (potassium chlorate, sodium chlorate, strontium chlorate, etc.), bromates (potassium bromate, sodium bromate, strontium bromate, etc.), iodates (potassium iodate, sodium iodate, strontium iodate, etc.), perchlorates (potassium perchlorate, sodium perchlorate, strontium perchlorate, etc.), perbromates (potassium perbromate, sodium perbromate, strontium perbromate etc.) and periodates (potassium periodate, sodium periodate, strontium periodate, etc.) are instanced. According to the present invention, one kind or mixture of two or more kinds selected from these groups are used.

Among these oxidizing agents, since the nitrates and nitrites in particular have the property of absorbing heat to decompose during the reaction, when used singly, as mentioned above, they are inferior in combustibility to the other oxidizars, and can often cause interruption of the combustion disadvantageously. However, their combustibility can be improved by using in combination with the hydrotalcite which is the binder of the present invention or further added combustion catalyst as described later, so that even the compounds included in the tetrazole group inferior in combustibility are allowed to be completely burned out. On the other hand, the ammonium salts have the disadvantage in hygroscopicity, but such a disadvantage does not matter a lot when it is considered that the airbag explosive composition is filled in the closed container after forming into a tablet form or a granule form, rather is outweighed by their effect of increasing an amount of gas yield during the combustion.

It is noted that only the strontium nitrate of the nitrates exhibits a specific behavior under the coexistence with the hydrotalcites and exhibits good combustibility and slag scavenging property without any combustion catalyst.

The salts of oxohalogen acid have a large pressure exponent n of the combustion reaction as described above, which makes it difficult to control the combustibility. However, their pressure exponent n can be reduced by combining the oxohalogen acid salt with the combustion catalyst as described later, so that the control of the combustion is facilitate. In addition, when the above said nitrates or nitrites is combined with the oxohalogen acid salts, the low combustibility of the nitrates or nitrites can be supplemented by the powerful combustibility of the oxohalogen acid salt. Accordingly, it is a preferable combination in a mixed oxidizing agent, which contains nitrate or nitrite as the major ingredient and the oxohalogen acid salt as remainders. In addition, the disadvantage of the nitrates and the nitrites of absorbing heat to decompose during the reaction can conversely provide an advantageous effect that rapid combustion by the oxohalogen acid salts is restrained, as a result, the combustion is maintained at low temperature, and an amount of generating NOx is reduced.

These oxidizing agents are well combined in a tetrazole group compound by a stoichimetrical proportion required for oxidation of the tetrazole group compound, and are usually used in the range which includes the stoichimetrical value and its vicinity.

Next, description on the combustion catalysts which may be used as required in the present invention will be given below. The present invention of the explosive composition comprises one or more kinds of combustion catalysts selected from the group consisting of the following:

④ one or more kinds of Zr, Hf, Mo, W, Mn, Ni, Fe in the metal form or thier oxide or sulfide, or ⑤ one or more kinds of simple body of carbon, sulfur or phosphorus.

Specifically, in the group ④, $ZrO_2$ (zirconium oxide), $HfO_2$ (Hafnium oxide), $MoO_3$ (molybdenum trioxide), $MoS_2$ (molybdenum disulfide), W (tungsten), $WO_3$ (tungsten trioxide), $MnO_2$ (manganese dioxide), $KMnO_4$ (potassium permanganate), Fe (iron), $Fe_2O_3$ (iron oxide), FeS (iron sulfide) and NiO (nickel oxide) may be used. In the group ⑤, graphite or activated carbon may be used as carbon, and red phosphorus may be used as phosphorus. These combustion catalysts are used for performing the function of adjusting the rate of oxidation reaction (combustion reaction) of the oxidizing agents and tetrazole group compound. Specifically, the combustion catalysts have a function of increasing or decreasing the pressure exponent n and a function of accelerating or decelerating the combustion velocity. Preferably, the combustion catalysts added should be not more than 10% of the total explosive composition weight in order to prevent an impairment of gas yield per unit of explosive composition and to prevent an occurrence of an excessive combustion residual.

It has been proved through various tests that the combined use of these combustion catalysts and the above said nitrates or nitrites provides the following results. They are that, safety the tetrazole group compound's against impact and friction is maintained; that the combustibility is improved at a low combustion temperature which is a character possessed by the nitrates or nitrites; and that complete combustion is achieved without unburned residuals of tetrazole group compound.

Also, even when the nitrates or nitrites are used as the oxidizing agents, the effect of restraining the generation of NOx is maintained. On the other hand, it has been proved that the combined use of these combustion catalysts and the above said salts of oxohalogen acid such as chlorates and perchlorates can provide the result of reducing the above said pressure exponent n so that the control of the combustibility can be facilitated, while high combustibility of these strong oxidizing agents is maintained. As a result of this, accidents such as an explosion of the gas generator, which caused by an abnormal combustion arisen when the above said salts of oxohalogen acid are used singly, can be prevented to improve safety of the airbag system.

Next, an exemplary combination of the explosive composition of the present invention will be described below. The explosive composition basically comprises the fuel ingredient, the oxidizing agent and the binder. Specifically, one or more kinds of the above said tetrazole group compound of the ①–③, i.e., ① tetrazole group compounds including one or more hydrogen atoms; ② aminotetrazoles other than ①; and ③ an alkali metal salt, an alkali earth metal salt or an ammonium salt of the tetrazole grupe compunds of the above said ① or ②, are used as the fuel ingredient; strontium nitrate is used as the oxidizing agent; and the fuel ingredient and the oxidizing agent are bound by the hydrotalcites serving as the binder.

This combination provides the effects that the tetrazole group compounds are allowed to be burned. in stable by operation of the hydrotalcites without any particular use of the above said combustion catalysts and that an easily scavengable slag is formed.

It is also a preferable embodiment that water-soluble polymers may be further added as a formability adjustor in order to improve the formability of the explosive composition according to the present invention. As the water-soluble polymers, there are polyethylene glycol, polypropylene glycol, polyvinyl ether, polymaleic copolymers, polyethylene imine, polyvinyl alcohol, polyvinyl pyrrolidone, polyacrylamide, sodium polyacrylate and ammonium polyacrylate. Among others, polyvinyl alcohol is preferable from general judgment on costs, capabilities and processes.

Also, in forming the explosive composition of the present invention into a given form, one or more kinds of lubricants selected from the group consisting of stearic acid, zinc stearate, magnesium stearate, calsium stearate, aluminum stearate, molybdenum disulfide, graphite, atomized silica and boron nitride, may be added to improve the flowability of the mixture. The addition should preferably be 2% or less of the total amount of the explosive composition. However, when $MOS_2$ (Molybdenum sulfide), or BN (boron nitride) or graphite is adopted as the combustion catalyst, since these materials serve as a lubricant as well, the addition of the lubricant composition may be reduced in amount.

Also, a small amount of the above said lubricant may be added for effectively pulverizing the fuel ingredient and the oxidizing agent into a desired particle diameter. This allows the particles to be prevented from being consolidated each other during pulverization, so that the pulverization work is effectively performed. Most preferable among the above said lubricants is the atomized silica for this specific intended use, and the addition of the lubricant should preferably be in the range of 0.1 to 2.0% by weight with respect to the fuel ingredient or oxidizing agent to be pulverized.

Next, in case of the gas generating agent, it is produced by using the explosive composition of the present invention as follows. (a) The above said tetrazole group compounds and (b) the above said hydrotalcites serving as the oxidizing agent as well as the binder are pulverized into desired particle sizes respectively, as mentioned above, and are mixed, plus, if needed, (c) the above said combustion catalyst, modifier of a formability and lubricant may selectively be added and mixed, and then the mixture is filled in a mold in an usual manner and is pressed into a proper tablet form or disk-like form. There is no particular limitation on form and size of the moldable parts, so the moldable parts may be formed into various sizes and shapes.

Also, in case of the enhancer, it is produced by using the explosive composition of the present invention as follows. The respective components are pulverized and mixed, as well as the case of the above-described gas generating agent, and then the mixture is formed into a granular form. Since the enhancer is particularly required to be burned at a faster combustion velocity than the gas generating agent, the enhancer is preferably formed into the granular form having a diameter of not more than 1.0 mm, specifically, in the range of 0.1 mm to 1.0 mm.

Also, a ratio of its compositions is not required to be particularly different from the case of forming the gas generating agent.

The gas generating agents press-formed or the granules of the enhancer may be heat-treated at 100 to 120° C. for about 2 to about 24 hours after press-forming or forming into the granular, so that the gas generating agents or the enhancers obtaine a resistant to a deterioration with age. Particularly, with respect to granules undergone the above heat-treatment, even in a harsh thermal aging resistance test of 107° C.×400 hours, the deterioration with age of the granules is a little.

An effect of the heat-treatment for less than 2 hours is insufficient and an effect of the heat-treatment for more than 24 hours will be of meaningless, for the reason of which the heat-treatment time should be properly selected from the range of 2 to 24 hours, preferably, 5 to 20 hours. Also, the heat treatment at less than 100° C. is not effective and that at more than 120° C. may cause deterioration rather than improvement, for the reason of which the heat treatment temperature should be selected from the range of 100 to 120° C., preferably, 105 to 115° C.

EXAMPLES

Next, detailed description on the exemplary examples of the present invention will be given with comparison with the prior art and comparative examples. First of all, the operation and effect provided by the hydrotalcites serving as the binder in the present invention will be described with reference to the following examples.

Example 1

39.2 parts by weight of 5-aminotetrazole (5ATZ) used as the fuel ingredient, 55.7 parts by weight of potassium perchlorate ($KClO_4$) used as the oxidizing agent and 5.1 parts by weight of HTS ($Mg_6Al_2(OH)_{16}CO_3\ 4H_2O$) used as the binder were mixed together and further a small amount of water was added thereto to be kneaded for 10 minutes with a stirring machine. Thereafter, the mixture was allowed to pass through a screen opening of 1 mm to screen particles. After heating and drying of this screened mixture, 0.2 parts by weight of magnesium stearate (St-Mg) was added thereto as the lubricant and mixed in order to obtain the explosive composition of the present invention. Hereon, the above 0.2 parts by weight is expressed at outer percentage, i.e. 0.2 parts by weight per 100 parts by weight of the screened mixture above. Then, the resulting mixture was press-formed with a rotary type tablet making apparatus to obtain disk-like gas generating tablets of 7.0 mm ϕ in diameter and 3 mm in thickness. The tablets thus obtained were measured on their crushing strength with respect to a direction of the diameter with a Monsant type hardness meter (the measured values were expressed in a mean value of the crushing strength of 20 tablets; the same is applied to the following). The tablets were subjected to a combustion test. A closed container of stainless steel was prepared to be subjected to a combustion test, which comprises a tablet combustion chamber of 40 cc and a residual scavenging chamber of 960 cc, a stainless steel plate having 7 holes of 10 mm ϕ at a boundary between the tablet combustion chamber and a residual scavenging chamber, a woven wire of a stainless steel (20 in mesh and 0.4 mm in diameter of wire) placed on the stainless steel plate and an aluminum foil (50 $\mu$ in thickness) placed on the stainless steel plate. The tablets were disposed in the tablet combustion chamber. In the combustion test, the gas generating agents were ignited with an electrical igniter and a pressure generated was observed with an oscilloscope via a pressure sensor in order to measure a time required for the generated pressure reaching to the maximum pressure.

Further, the tablets were subjected to a thermal shook test to be sealed in an aluminum container. In the thermal shook test, environment changed 200 times between −40° C.×30 min. and 90° C.×30 min. A tablet collapsing test by pressure and a combustion test of the tablets before and after the thermal shock were performed. The test results are shown in TABLE 1.

TABLE 1

(Table of Comparative Test Results on Effect of Binder)

| | | The Present Invention | | | Comparative Example | |
|---|---|---|---|---|---|---|
| | | Example 1 | Example 2 | Example 3 | Compar. Ex. 1 | Compar. Ex. 2 |
| Fuel | 5ATZ | 39.2 | 35.7 | — | 34.3 | 39.2 |
| | 5ATZ-Na | — | — | 41.0 | — | — |
| Oxidizing agent | $KClO_4$ | 55.7 | — | — | — | 55.7 |
| | $KNO_3$ | — | 59.5 | 54.2 | — | — |
| | $Sr(No_3)_2$ | — | — | — | 61.0 | — |
| Binder | HTS | 5.1 | 4.8 | — | — | — |
| | Pyroaurite | — | — | 4.8 | — | — |
| | Bentonite | — | — | — | 4.7 | — |
| | $Ca_3(PO_4)_2$ | — | — | — | — | 5.1 |
| Lubricant* | St-Mg | 0.2 | — | — | — | 0.2 |
| | St-Zn | — | — | — | 0.2 | — |
| | $MoS_2$ | — | 0.2 | — | — | — |
| | Graphite | — | — | 0.2 | — | — |
| Early Stage | Strength of Pellet (Kg) | 27.5 | 28.6 | 27.7 | 14.9 | 24.0 |
| | P-t max. (ms) | 50 | 57 | 57 | 50 | 52 |
| After Thermal Shock | Strength of Pellet (Kg) | 21.8 | 27.0 | 24.1 | 4.1 | 11.0 |
| | P-t max. (ms) | 51 | 59 | 56 | 12 | 24 |

*An adding amount of the lubricant is expressed at an outer percentage.

Example 2

35.7 parts by weight of 5ATZ used as the fuel ingredient, 59.5 parts by weight of potassium nitrate ($KNO_3$) used as the oxidizing agent and 4.8 parts by weight of HTS used as the binder were mixed together and formed granularly by the same manner as the case of Example 1. Then, 0.2 parts by weight, expressed at outer percentage, of molybdenum disulfide ($MoS_2$) used as the lubricant was mixed therewith and thereafter was press-formed into tablets in a similar manner. The tablets thus obtained were subjected to the same tests as those of Example 1. The test results are shown in TABLE 1.

Example 3

41.0 parts by weight of 5-aminotetrazole sodium salt (5ATZ-Na) used as the fuel ingredient, 54.2 parts by weight of $KNO_3$ used as the oxidizing agent and 4.8 parts by weight of pyroaurite used as the binder were mixed together and formed granularly by the same manner as the case of Example 1. Then, 0.2 parts by weight, expressed at outer percentage, of graphite used as the lubricant was added thereto and mixed and thereafter was press-formed into tablets in a similar manner. The tablets thus obtained were subjected to the same tests as those of Example 1. The test results are shown in TABLE 1.

Comparative Example 1

34.3 parts by weight of 5ATZ used as the fuel ingredient, 61.0 parts by weight of strontium nitrate ($Sr(No_3)_2$) used as the oxidizing agent and 4.7 parts by weight of bentonite used as the binder were mixed together and formed granularly by the same manner as the case of Example 1. Then, 0.2 parts by weight, expressed at outer percentage, of zinc stearate (St-Zn) used as the lubricant was added thereto and mixed and thereafter was press-formed into tablets in a similar manner. The tablets thus obtained were subjected to the same tests as those of Example 1, for comparison purposes. The test results are shown in TABLE 1.

Comparative Example 2

39.2 parts by weight of 5ATZ used as the fuel ingredient, 55.7 parts by weight of $KClO_4$ used as the oxidizing agent and 5.1 parts by weight of tricalcium phosphate ($Ca_3(PO_4)_2$) used as the binder were mixed together and formed granularly by the same manner as the case of Example 1. Further, 0.2 parts by weight, expressed at outer percentage, of St-Mg used as the lubricant was added thereto and mixed and thereafter was press-formed into tablets in a similar manner. The tablets thus obtained were subjected to the same tests as those of Example 1, for comparison purposes. The test results are shown in TABLE 1.

As obvious from TABLE 1, with reapect to the tablet collapsing test by pressure, the collapsing strength before thermal shock of the gas generating agents of Examples 1–3 containing the hydrotalcites as the binder and that of Comparative Example 2 containing the tricalcium phosphate as the binder were higher than 10–15 Kg of the collapsing strength of a conventional type gas generating agent containing azide as the fuel ingredient. Also, the collapsing strength after thermal shock of the tablets of the present invention changed little, whereas that of the tablet of Comparative Example 2 was lowered down to ⅓ of the initial value or less.

In the case of Comparative Example 1 with bentonite as the binder, when trying to make the tablets through the application of a strong force in order to enhance the collapsing strength, capping, or in the worse case, lamination was produced in possess of making tablets, for the reason of which it was impossible to obtain the collapsing strength of 15 Kg or more. In addition, the collapsing strength after thermal shock test of the tablets of Examples 1–3 changed little and their forms were maintained without changes, whereas the collapsing strength of the tablet of Comparative Example 1 containing bentonite as the binder was considerably lowered, and also their form was partly collapsed.

These results show that, with respect to the time required for reaching to the maximum pressure (P-t max) in the combustion test, the tablets of the present invention provide no great difference between before and after the thermal shook test and thus provide a long-term stability. In contrast, the tablet of Comparative Example 1 shows the same vigorous combustion velocity as in the case of combustion of powder and the tablet of Comparative Example 2 shows a combustion velocity twice or more as fast as the early stage, so that either of these two comparative examples are lack of stability.

Example 4

Next, the operation and effect of the combustion catalyst in combination with tetrazole group compounds and hydrotalcites used in the present invention will be described by the following examples.

The fuel ingredient was prepared by a following manner. Atomized silica of 1.0 parts by weight, having an 1 μm or less particle diameter was added to 5ATZ in advance. The 5ATZ mixed with the atomized silica was pulverized into 10 μm or less particle diameter. The 50% average particle diameter of the reference number was 30 μm. Then, 5ATZ of 34.1 parts by weight (including atomized silica of 0.3 parts by weight) was used as the fuel ingredient.

The oxidizing agent was prepared by a following manner. Atomized silica of 1.0 parts by weight was added to potassium nitrate ($KNO_3$) in advance. The potassium nitrate ($KNO_3$) mixed with the atomized silica was pulverized into 100 μm or less particle diameter. The 50% average particle diameter of the reference number was 25 μm. Then, the potassium nitrate ($KNO_3$) of 56.8 parts by weight (including 0.6 parts by weight atomized silica) was used as the oxidizing agent.

HTS of 4.6 parts by weight was prepared by pulverizing into 50 μm or less particle diameter. The 50% average particle diameter of the reference number was 10 μm. Various kinds of combustion catalysts of 4.5 parts by weight were prepared by pulverizing into 30 μm or less particle diameter. The 50% average particle diameter of the reference number was 2 μm.

The above fuel ingredient, oxidizing agent, HTS and respective combustion catalyst were fully mixed together in a Vee-mixer. Then, 0.2 parts by weight, expressed at outer percentage, of magnesium stearate (St-Mg) used as the lubricant was added thereto to be mixed. Then, the mixture was filled in a specified mold, and then press-formed into a tablet form in order to obtain tablets of gas generating agents of which diameter was 7 mm, thickness was 4 mm and weight was about 250 mg.

Similarly, the fuel ingredient was prepared by a following manner. Atomized silica of 1.0 parts by weight, having an 1μm or less particle diameter, was added to 5-aminotetrazole potassium salt (5ATZ-K) in advance. The 5-aminotetrazole potassium salt (5ATZ-K) mixed with the atomized silica was pulverized into 100 μm or less particle diameter. The 50% average particle diameter of the reference number was 30 μm. The 5-aminotetrazole potassium salt (5ATZ-K) of 42.0 parts by weight (including 0.42 parts by weight atomized silica) was used as the fuel ingredient.

The oxidizing agent was prepared by a following manner. Atomized silica of 1.0 parts by weight was added to $KNO_3$ in advance. The $KNO_3$ mixed with the atomized silica was pulverized into 100 μm or less particle diameter. The 50% average particle diameter of the reference number was 25 μm. The $KNO_3$ of 48.9 parts by weight (including 0.48 parts by weight atomized silica) used as the oxidizing agent.

HTS of 4.6 parts by weight was prepared by pulverizing into 50 μm or less particle diameter. The 50% average particle diameter of the reference number was 10 μm. Various kinds of combustion catalysts of 4.5 parts by weight were prepared by pulverizing into 30 μm or less particle diameter. The 50% average particle diameter of the reference number was 2 μm.

The above fuel ingredient, oxidizing agent, HTS and various kinds of combustion catalysts were fully mixed together in a Vee-mixer. Then, 0.2% by weight, expressed at outer percentage, of St-Mg was added thereto as the lubricant to be mixed, then filled in a specified mold, and then press-formed into a tablet form. The tablets of gas generating agents were obtained, of which each diameter is 7 mm, each thickness is 4 mm and each weight is about 250 mg. Further, similar tablets except for including no combustion catalysts were also produced for comparison purposes. These various kinds of tablets were used for continuous combustion tests as follows. The tablets were exposed to gas burner flame till ignitions occurred, after that, immediately set apart away from the flame, then tested about the continuous combustibility. The test results are shown in TABLE 2.

TABLE 2 shows that only a simple combination (No. 30) of 5ATZ and $KNO_3$ produced interruption of the combustion and was difficult to use for the gas generating agent, whereas those numbers through 1 to 18 using the combustion catalyst all allowed the gas generating agents to be burned completely without unburned residuals. It also shows that those numbers of 31 and 32 shown as Comparative Examples using CuO and $TiO_2$ respectively presented little effect as the combustion catalyst and caused the same interruption of the combustion as the case of adding no combustion catalyst. Thus these Comparative Examples were somewhat inferior as the gas generating agent.

TABLE 2

(Table of Continuous Combustibility Test Results Provided By Various Kinds of Combustion (Adjustors)

| Test Number | | Fuel Ingredient | Combustion Adjustor | Behavior after apart from flame after ignition |
|---|---|---|---|---|
| The Present Invention | 01 | 5ATZ | $ZrO_2$ | Complete combustion was achieved without interruption |
| | 02 | as above | $HfO_2$ | as above |
| | 03 | as above | $MoO_3$ | as above |
| | 04 | as above | $MoS_2$ | as above |
| | 05 | as above | W | as above |
| | 06 | as above | $WO_3$ | as above |
| | 07 | as above | $MnO_2$ | as above |
| | 08 | as above | $KMnO_4$ | as above |
| | 09 | as above | Fe | as above |
| | 10 | as above | $Fe_2O_3$ | as above |
| | 11 | as above | FeS | as above |
| | 12 | as above | NiO | as above |
| | 13 | as above | Graphite | as above |
| | 14 | as above | Activated Carbon | as above |
| | 15 | as above | Red phosphorus | as above |
| | 16 | 5ATZ-K | $MoO_3$ | as above |
| | 17 | as above | $MoS_2$ | as above |
| | 18 | as above | $Fe_2O_3$ | as above |
| Compar. Example | 30 | 5ATZ | None | Combustion interrupted and unburned residuals remained. |
| | 31 | as above | CuO | as above |
| | 32 | as above | $TiO_2$ | as above |

Example 5

Next, description on the safety test of Examples of the explosive composition of the present invention will be given in comparison with Comparative examples. Four kinds of gas generating agents were subjected to safety tests, which were the gas generating agent of the present invention (Nos. 1–18) as used in Example 4 above; the gas generating agent No. 30 without any combustion catalyst; the gas generating agent (No. 33) having known sodium azide as its major ingredient; and the gas generating agent (No. 34) containing potassium perchlorate (KClO4) newly prepared in the manner described in Example 4 as the oxidizing agent. The safety tests were a drop hammer sensitivity test and a friction sensitivity test in accordance with the requirements of JIS K4801. The results are shown in TABLE 3.

No. 33: A known gas generating agent with sodium azide as the fuel ingredient; and No. 34: A known tetrazole base gas generating agent which is a mixture containing 41.2 parts by weight of 5ATZ as the fuel ingredient and 58.8 parts by weight of $KClO_4$ as the oxidizing agent without any combustion catalysts and hydrotalcites.

At test magnitude columns in TABLE 3, the safety degree increases in accordance with the numerical growth, whereas, sensitivities to the drop hammer and to the friction decreases.

As apparent from TABLE 3, the combination (No. 30) of 5ATZ and nitrate represents high numerical values on safety not only in the drop hammer test but also in the friction test as compared with the gas generating agent (No. 33) with sodium azide as its major ingredient.

Further, this high safety was maintained when the combustion catalyst was further combined therewith (Nos. 1–18). On the other hand, only a simple combination of tetrazoles and nitrate presents a problem with an ability of combustion as aforementioned. Also, the one (No. 34) simply substituting perchlorate for nitrate in order to try to improve the ability of combustion had substantially the same safety as the gas generating agent including sodium azide as its major ingredient. This indicates that it was useless to substitute the tetrazoles for the metallic compound azide to improve the safety.

TABLE 3

(Table of Drop Hammer Sensitivity Test Result and Friction Sensitivity Test Result Provided By Various Kinds of Combustion Adjustors)

| Test Number | | Fuel ingredient | Combustion Adjustor | Drop Hammer Sensitivity Test Magnitude | Friction Sensitivity Test Magnitude |
|---|---|---|---|---|---|
| The Present Invention | 01 | 5ATZ | $ZrO_2$ | Magnitude 7 | Magnitude 7 |
| | 02 | as above | $HfO_2$ | as above | as above |
| | 03 | as above | $MoO_3$ | as above | as above |
| | 04 | as above | $MoS_2$ | as above | as above |
| | 05 | as above | W | as above | as above |
| | 06 | as above | $WO_3$ | as above | as above |
| | 07 | as above | $MnO_2$ | as above | as above |
| | 08 | as above | $KMnO_4$ | as above | as above |
| | 09 | as above | Fe | as above | as above |
| | 10 | as above | $Fe_2O_3$ | as above | as above |
| | 11 | as above | FeS | as above | as above |
| | 12 | as above | NiO | as above | as above |
| | 13 | as above | Graphite | as above | as above |
| | 14 | as above | Activated Carbon | as above | as above |
| | 15 | as above | Red phosphorus | as above | as above |
| | 16 | 5ATZ-K | $MoO_3$ | as above | as above |
| | 17 | as above | $MoS_2$ | as above | as above |
| | 18 | as above | $Fe_2O_3$ | as above | as above |
| Compara. Example | 30 | 5ATZ | None | Magnitude 7 | Magnitude 7 |
| | 33 | Sodium Azide | None | Magnitude 5 | Magnitude 6 |
| | 34 | 5ATZ | None | Magnitude 5 | Magnitude 6 |

Example 6

Next, a description on a combustion characteristics of the gas generating agent using the tetrazoles of the present invention will be given in comparison with Comparative Examples. Three kinds of gas generating agent were respectively filled in such gas generators 1 as shown in FIG. 1 to be subjected to 60 liter tank tests, which were 30 g of the same gas generating agent using $MoO_3$ of the combustion catalysts as No. 3 in the Example 4, 30 g of the same gas generating agent using $MoS_2$ of the combustion catalysts as No. 4 in the Example 4 and 30 g of the same gas generating agent without any combustion catalyst as No. 30 (Comparative Example) in the Example 4.

The gas generator 1 shown in FIG. 1 was partitioned into an innermost chamber A for ignition, an intermediate chamber B for combustion and an outermost chamber C for filtering by two inner partitions a, b and an outer wall c. In the ignition chamber A, there were provided an igniter 2 which was ignited by an electric current coming from outside through an electric passage and an enhancer 3 which was ignited by the igniter 2. High temperature gas produced by the combustion of the enhancer 3 passes through inflammation holes 4 formed in the inner partition a to burn gas generating agents 5 filled in a olosed container (not shown) accommodated in the combustion chamber B. The gas generated by the combustion of the gas generating agents 5 passes through first gas outlets 6 formed in the partition b into the filter chamber C. By means of the filters 7 in the filter chamber C, the gas was cooled and slags contained in the gas were removed, then the gas was ejected out from second gas outlets 8 formed in the outer partition In the gas generator structured as above, an outlet velocity of the gas was governed by aperture areas of the first gas outlets 6. When the aperture areas of the first gas outlets 6 were too small against an amount of gas produced in the combustion chamber B, an internal pressure in the combustion chamber B increases with time. And the combustion velocity was further accelerated as shown in the above said formula (5), which will cause an explosion of the gas generator in extreme cases. On the other hand, when the aperture areas of the first gas outlets 6 were too large against the amount of gas produced in the combustion chamber B, the internal pressure in the combustion chamber B does not increase and the combustion velocity slows.

Accordingly, as Examples, three kinds of gas generators having the total aperture areas of the first gas outlets 6 of 200 $mm^2$, 300 $mm^2$ and 400 $mm^2$ respectively were used for 60 liter tank tests. The test results are shown in TABLE 4.

Figure 2:
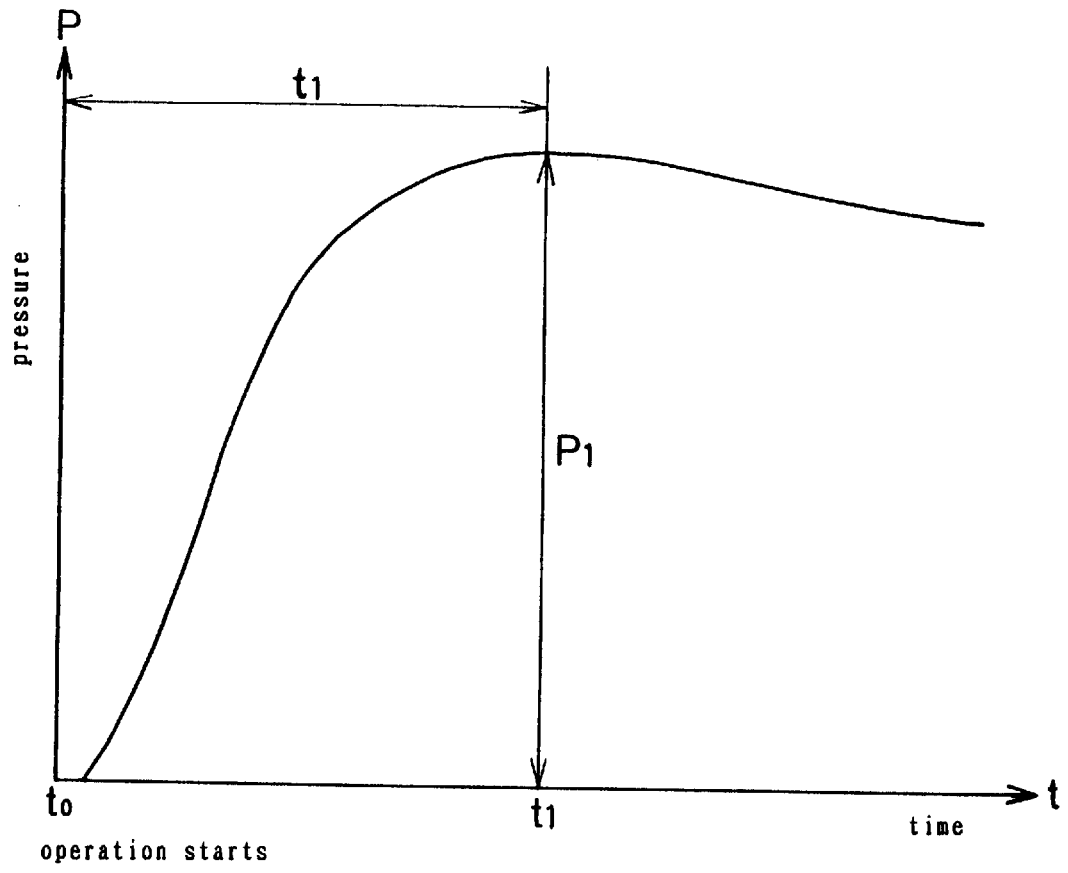
FIG. 2 is a conceptual view diagrammatically illustrating P-t of a 60 liter tank test made in Examples of the present invention.

The 60 liter tank test was a test for measuring changes of the internal pressure P of a closed 60 liter tank in which the gas generator was set and operated. In this test with respect to time t, the P-t diagrammatic view as shown in FIG. 2 is obtained. In FIG. 2, $t_0$ represents the time from which operation of the gas generator stated; $t_1$ represents the time at which the pressure P reached the maximum value Pm and $t_m$ represents the time ($t_1$–$t_0$) required for reaching the maximum pressure. In the P-t diagrammatic view, the combustion velocity is fast when the pressure P is depicted by a sharply rising curve and there is a fear of possible occurrence of explosion of the gas generator when $P_m$ is too high. Also, much time is needed for expanding the airbag when $t_m$ is too long. This means that the gas generating agent is improper for a gas generating agent for an airbag since the air bag is required to expand instantaneously. Thus, in Examples, a preferable range for $P_m$ is set to the range of 150 to 250 kPa and that for $t_m$ is set to the range of 150 ms or less though these ranges of $P_m$ and $t_m$ vary with size of an airbag, a mounting position of the airbag and uses thereof (for driver's seat use, for occupant's seat use, for side collision protection use, etc.).

It will be appreciated from TABLE 4 that, in any cases, the maximum pressure $P_m$ increases and also the time $t_m$ required till the maximum pressure decreases as the total aperture areas of the first gas outlets decreases. These facts show the tendency to facilitate the combustion as the total aperture areas of the first gas outlets decreases. Particularly, even when Comparative Example (No. 30) without combustion catalyst, a similar combustion state to that of the present invention was obtained under the condition C . However, when Comparative Example (No. 30) without combustion catalyst, unburned residuum were produced and $t_m$ took 2 seconds under the both conditions A and B. The 2 seconds of $t_m$ were too long for inflating the airbag. In contrast, in any cases, the explosive compositions of the present invention was completely burned and the values of $P_m$ and $t_m$ fell in reference ranges. This means that those explosive compositions have a very broad stable combustion range, from which it can be understood that the structural design of the gas generator can be very much facilitated.

TABLE 4

(60 Liter Tank Test Result)

| Test Number | | Combustion Adjustor | | Condition A 400 $mm^2$ | Condition B 300 $mm^2$ | Condition C 200 $mm^2$ |
|---|---|---|---|---|---|---|
| The Present Invention | 03 | $MoO_3$ | $P_m$ | 150 kPa | 180 kPa | 200 kPa |
| | | | $t_m$ | 90 ms | 70 ms | 50 ms |
| | | | N.B | Complete Combustion | Complete Combustion | Complete Combustion |
| | 04 | $MoS_2$ | $P_m$ | 150 kPa | 180 kPa | 200 kPa |
| | | | $t_m$ | 90 ms | 70 ms | 50 ms |
| | | | N.B | Complete Combustion | Complete Combustion | Complete Combustion |
| Compara. Example | 30 | None | $P_m$ | 50 kPa | 50 kPa | 200 kPa |
| | | | $t_m$ | 2 sec. | 2 sec. | 50 ms |
| | | | N.B | Unburned Residuals Remained | Unburned Residuals Remained | Complete Combustion |

Example 7

Even combustibility of the explosive compositions using oxohalogen acid salt which have had difficulties in controlling the combustibility, can be controlled by a combination with the combustion catalyst mentioned above, the test examples of which will be described next. The explosive compositions used in the combustibility controlling tests are as follows.

No. 4: the explosive composition of the present invention obtained in Examples 4 and 5 using $KNO_3$ as the oxidizing agent and using $MoS_2$ as the combustion catalyst;

No. 19: the explosive composition of the present invention with 37.5 parts by weight of 5ATZ as the fuel ingredient, 53.4 parts by weight of $KClO_4$ of strong oxidative as the oxidizing agent, 4.5 parts by weight of $Fe_2O_3$ as the combustion catalyst and 4.6 parts by weight of HTS being mixed;

No. 30: the explosive composition used as a Comparative Example with no addition of the combustion catalysts used in Examples 4 and 5;

No. 33: the explosive composition having sodium azide used in Example 2 as the major ingredient; and No. 35: the explosive composition used as a Comparative Example, which is the same composition as No. 19 except having no combustion catalyst such as $Fe_2O_3$.

Each of the above said five kinds of explosive compositions was filled in a specified mold and press-formed to obtain a given formed body which has 8 mm height, 5 mm width and 50 mm length and about 3.6 g weight. After an epoxy resin was applied to side surfaces of each of the formed bodies, two holes of 0.5 mm in diameter were bored in the each formed bodies at an adequate interval in the longitudinal direction and a fuse was inserted through each of the holes, to thereby produce test pieces.

Each of the test piece was placed in a specified container and a nitrogen was filled therein till a given pressure. And, the test piece was heated at its one end to be ignited via a nichrome wire for measurement of the times required for the respective fuses to be burnt out. The distance between the two fuses was divided by the difference between the times required for the respective fuses to be burnt out in order to estimate the combustion velocity. Further, the variety of combustion velocity were determined while changing the pressure from 1 to 50 atm in the container in order to calculate the pressure exponent n with using the above said formula (5). The results are shown in TABLE 5.

TABLE 5 shows that, when potassium perchlorate ($KClO_4$) of a powerful oxidizing agent was used as the oxidizing agent, the pressure exponent n in Example (No. 19) of the present invention was 0.4, which fell in the range of 0.3 to 0.45 which was considered to be preferable for the gas generating agent, whereas the pressure exponent n in Comparative Example (No. 35) without combustion catalyst was 0.6 which was a high value for the gas generating agent. In addition, when potassium nitrate ($KNO_3$) was used as the oxidizing agent, the pressure component n in Example (No, 4) of the present invention was 0.3 which showed the combustibility equivalent to that of the known explosion composition (No. 33) having sodium azide as its major ingredient, whereas the pressure component n in the case (No. 30) using no combustion catalyst was 0.5 which was a high value for the gas generating agent.

This fact indicates that the combustion catalyst of the present invention has the function of reducing the pressure exponent n as well. This fact further indicates that the pressure exponent n of even the known combination of tetrazoles and oxohalogen acid salts such as potassium perchlorate of strong oxidatives can be reduced by adding a prescribed combustion catalyst. As you know, the known combination of tetrazoles and oxohalogen acid salts had difficulties in controlling the combustibility before. Consequently, the combustibility control is facilitated.

TABLE 5

(Pressure Exponent Measurement Test Result)

| Test Number | | Fuel ingredient | Combustion Adjustor | Oxidizing agent | Pressure Exponent (value n) |
|---|---|---|---|---|---|
| The Present Invention | 04 | 5ATZ | $MoS_2$ | $KNO_3$ | 0.3 |
| | 19 | as above | $Fe_2O_3$ | $KClO_4$ | 0.4 |
| Compara. Example | 30 | as above | None | $KNO_3$ | 0.5 |
| | 33 | Sodium Azide | — | — | 0.3 |
| | 35 | 5ATZ | None | $KClO_4$ | 0.6 |

Example 8

Next, the relation between the combustion characteristics and the slag formability provided by combination of said various kinds of combustion catalysts with the various kinds of binders will be described in comparison between Examples of the present invention and Comparative Examples.

The fuel ingredient was prepared by a following manner. Atomized silica of 1.0 parts by weight having an 1 μm or less particle diameter was added to 5ATZ in advance. The 5ATZ mixed with the atomized silica was pulverized into 10 μm or less particle diameter. The 50% average particle diameter of the reference number was 25 μm. Then, 5ATZ of 34.1 parts by weight (including atomized silica of 0.3 parts by weight) was used as the fuel ingredient.

The oxidizing agent was prepared by a following manner. Atomized silica of 1.0 parts by weight was added to potassium nitrate ($KNO_3$) in advance. The potassium nitrate ($KNO_3$) mixed with the atomized silica was pulverized into 100 μm or less particle diameter. The 50% average particle diameter of the reference number was 35 μm. Then, the potassium nitrate ($KNO_3$) of 56.8 parts by weight (including 0.6 parts by weight atomized silica) was used as the oxidizing agent.

Various kinds of binders of 4.6 parts by weight was prepared by pulverizing into 50 μm or less particle diameter. The 50% average particle diameter of the reference number was 10 μm. Various kinds of combustion catalysts of 4.5 parts by weight were prepared by pulverizing into 30 μm or less particle diameter. The 50% average particle diameter of the reference number was 2 μm.

The above fuel ingredient, oxidizing agent, respective binder and respective combustion catalyst were fully mixed together in a Vee-mixer. Then, 0.1 parts by weight, expressed at outer percentage, of St-Mg used as the lubricant was added thereto to be mixed. Then, the mixture was filled in a specified mold, and then press-formed into a tablet form in order to obtain tablets of gas generating agents of which diameter was 7 mm, thickness was 4 mm and weight was about 250 mg.

Similarly, the fuel ingredient was prepared by a following manner. Atomized silica of 1.0 parts by weight having an 1 μm or less particle diameter, was added to 5-aminotetrazole potassium salt (5ATZ-K) in advance. The 5-aminotetrazole potassium salt (5ATZ-K) mixed with the atomized silica was pulverized into 100 μm or less particle diameter. The 50% average particle diameter of the reference number was 25 μm. The 5-aminotetrazole potassium salt (5ATZ-K) of 42.0 parts by weight (including 0.42 parts by weight atomized silica) was used as the fuel ingredient.

The oxidizing agent was prepared by a following manner. Atomized silica 1.0 parts by weight was added to $KNO_3$ in advance. The $KNO_3$ mixed with the atomized silica was pulverized into 100 μm or less particle diameter. The 50% average particle diameter of the reference number was 35 μm. The $KNO_3$ of 48.9 parts by weight (including 0.48 parts by weight atomized silica) used as the oxidizing agent.

Various kinds of binders of 4.6 parts by weight was prepared by pulverizing into 50 μm or less particle diameter. The 50% average particle diameter of the reference number was 10 μm. Various kinds of combustion catalysts of 4.5 parts by weight were prepared by pulverizing into 30 μm or less particle diameter. The 50% average particle diameter of the reference number was 2 μm.

The above fuel ingredient, oxidizing agent, respective binder and respective combustion catalyst were fully mixed together in a Vee-mixer.

Then, 0.1% by weight, expressed at outer percentage, of St-Mg was added thereto as the lubricant to be mixed, then filled in a specified mold, and then press-formed into a tablet form. The tablets of gas generating agents were obtained, of which each diameter is 7 mm, each thickness is 4 mm and each weight is about 250 mg.

Further, similar tablets except for including no binders were also produced for comparison purposes. These various kinds of tablets were used for continuous combustion tests as follows and the slag formability. The tablets were exposed to gas burner flame till ignitions occurred, after that, immediately set apart away from the flame, then tested about the continuous combustion and the slag formability. The test results are shown in TABLE 6.

TABLE 6 shows that even the combinations of tetrazoles and nitrates were burnt completely by adding combustion catalysts (Nos. 101 to 116). Also, the combinations of tetrazoles, nitrates and combustion catalysts with containing hydrotalcite group (Nos. 101–116) provide slag formation, whereas those containing no hydrotalcite group (Nos. 130–132) do not provide the slag formation even though they are completely burnt.

TABLE 6

Table of Test Results On Continuous Combustibility and Slag Formability Provided By Various Kinds Of Combustion Adjustors And Binders

| Test Number | | Fuel ingredient | Combustion Adjustor | Kind of Binder | Behavior After Ignition | With or Without Slag Formation |
|---|---|---|---|---|---|---|
| The Present Invention | 101 | 5ATZ | $ZrO_2$ | HTS | Complete Combustion | With it |
| | 102 | as above | $HfO_2$ | as above | as above | as above |
| | 103 | as above | $MoO_3$ | as above | as above | as above |
| | 104 | as above | $MoS_2$ | as above | as above | as above |
| | 105 | as above | W | Pyroaurite | Complete Combustion | With it |
| | 106 | as above | $WO_3$ | as above | as above | as above |
| | 107 | as above | $MnO_2$ | as above | as above | as above |
| | 108 | as above | $KMnO_4$ | as above | as above | as above |
| | 109 | 5ATZ-K | Fe | HTS | Complete Combustion | With it |
| | 110 | as above | $Fe_2O_3$ | as above | as above | as above |
| | 111 | as above | FeS | as above | as above | as above |
| | 112 | as above | Nio | as above | as above | as above |
| | 113 | as above | Graphite | as above | as above | as above |
| | 114 | as above | Activated Carbon | Pyroaurite | Complete Combustion | With it |
| | 115 | as above | Red Phosphorus | as above | as above | as above |
| | 116 | as above | $MoO_3$ | as above | as above | as above |
| Compara. Example | 130 | 5ATZ | $MoO_3$ | None | Complete Combustion | Without it |
| | 131 | as above | $Fe_2O_3$ | None | as above | as above |
| | 132 | 5ATZ-K | $MoO_3$ | None | as above | as above |

Example 9

Next, description on the thermal shock properties provided by the combinations of various kinds of binders and combustion catalysts will be given in comparison between Examples of the present invention and Comparative examples.

The explosion compositions (Nos. 101–116, 130–132) used in Example 8 were used for a tablets collapsing test by pressure and a combustion test in an 1 liter container. The tablets collapsing test by pressure were performed before and after a thermal shock test. The thermal shock test was a test in which a thermal cycle of −40° C.×30 min. to +90° C.×30 min. was repeated 200 times. Also, the combustion test in the 1 liter container were performed before and after a thermal shock test. The combustion test in the 1 liter container was a test in which there was an explosion composition of 10 g in the closed 1 liter container and the time t-Pmax (ms: millisecond) was measured. The time t-Pmax was a time required for the internal pressure of the container reaching the maximum pressure after an ignition of the explosion composition.

The test results are shown in TABLE 7. TABLE 7 shows that the explosion compositions of the present invention (Nos. 101–116) using the hydrotalcite group as the binder provided no great difference of results of the tablets collapsing test by pressure after and before the thermal shock test. Also, there was no great difference of results of the combustion test in an 1 liter container after and before the thermal shock test. In contrast to this, those of Comparative Examples (Nos. 130–132) adding no hydrotalcite group collapsed in the tablets collapsing test after the thermal shock test.

TABLE 7

(Table of Thermal Shock Test Result Provided By Combination Of Various Kinds Of Combustion Adjustors and Binders)

| Test Number | | Fuel Ingredient | Combustion Adjustor | Binder | Strength Of Pellet In Early Stage (kgf) | Strength After Thermal Shock (kgf) | t-Pmax (ms) In Early Stage | t-Pmax (ms) After Thermal Shock |
|---|---|---|---|---|---|---|---|---|
| The Present Invention | 101 | 5ATZ | $ZrO_2$ | HTS | 27 | 27 | 161 | 160 |
| | 102 | as above | $HfO_2$ | as above | 28 | 28 | 155 | 156 |
| | 103 | as above | $MoO_3$ | as above | 29 | 28 | 152 | 149 |
| | 104 | as above | $MoS_2$ | as above | 26 | 25 | 143 | 140 |
| | 105 | as above | W | Pyroaurite | 25 | 23 | 172 | 170 |
| | 106 | as above | $WO_3$ | as above | 23 | 23 | 166 | 162 |
| | 107 | as above | $MnO_2$ | as above | 26 | 25 | 158 | 153 |
| | 108 | as above | $KMnO_4$ | as above | 27 | 26 | 122 | 118 |
| | 109 | 5ATZ-K | Fe | HTGS | 27 | 26 | 154 | 151 |
| | 110 | as above | $Fe_2O_3$ | as above | 26 | 25 | 156 | 153 |
| | 111 | as above | FeS | as above | 26 | 25 | 159 | 161 |
| | 112 | as above | NiO | as above | 26 | 25 | 165 | 166 |
| | 113 | as above | Graphite | as above | 25 | 24 | 170 | 173 |
| | 114 | as above | Activated | Pyroaurite | 24 | 24 | 165 | 166 |
| | 115 | as above | Red Phosphorus | as above | 23 | 23 | 158 | 154 |
| | 116 | as above | $MoO_3$ | as above | 25 | 24 | 171 | 168 |
| Compara. Example | 130 | 5ATZ | $MoO_3$ | None | 18 | collapsing | 144 | — |
| | 131 | as above | $Fe_2O_3$ | None | 21 | as above | 149 | — |
| | 132 | 5ATZ-K | $MoO_3$ | None | 20 | as above | 161 | — |

Example 10

Next, Examples in which the explosive compositions of the present invention are used as the enhancer, will be described. The same ingredients as Example 8 (Nos. 103 and 110 of the present invention and No. 130 of Comparative Example) were fully mixed together, then the mixture was pulverized. Thus, granules having 0.5 mm diameter were obtained as the enhancer.

The respective enhancer of 1 g and a gas generating agent of 35 g having the same composition as the enhancer were filled in a respective gas generator having the same structure as shown in FIG. 1. The same 60 liter tank tests as the case of Example 6 were performed with using the above gas generators in order to measure the P-t curve together with the combustion state and an amount of the slag emitted from the gas generator. In these Example also, a preferable range for the maximum pressure value $P_m$ was set to the range of 150 to 250 kPa, a preferable time $t_m$ required for reaching the maximum pressure was set to the range of 150 ms or less and a preferable slag emission amount was set to be 2 g or less, as well as the case of Example 6.

The test results are shown in TABLE 8. It will be appreciated from TABLE 8 that the maximum pressure $P_m$ increases and also the time $t_m$ required for reaching the maximum pressure decreases as the total aperture areas of the first gas outlets decreases in any cases, which tends to facilitate the combustion as well as the case of Example 6. Comparative Example (No. 130) using no hydrotalcite group presented satisfactory values for both the pressure $P_m$ and the time $t_m$ but presented a lot of slag emission amount, which indicates that filterable slags were not formed.

In contrast, in the explosive compositions (Nos. 103 and 110) of the present invention, the explosive compositions of the present invention was completely burnt and the values of $P_m$ and $t_m$ fell in reference ranges and also a small slag emission amount of about 1 g was presented. This means that those explosive compositions have a very broad stable combustion range, from which it can be understood that the structural design of the gas generator can be very much facilitated. Also, it is confirmed from these results that the explosive compositions of the present invention is fully usable as the enhancer.

TABLE 8

(60 Liter Tank Test Result)

| Test Number | | Combustion Adjustor (Binder) | | Condition A 400 $mm^2$ | Condition B 300 $mm^2$ | Condition C 200 $mm^2$ |
|---|---|---|---|---|---|---|
| The | 103 | $MoO_3$ | $P_m$ | 153 kPa | 188 kPa | 220 kPa |
| Present | | (HTS) | $t_m$ | 87 ms | 66 ms | 47 ms |
| Invention | | | Combustion | Complete Combustion | Complete Combustion | Complete Combustion |
| | | | Slag Emission Amount | 1.21 g | 1.32 g | 0.96 g |
| | 110 | $Fe_2O_3$ | $P_m$ | 150 kPa | 173 kPa | 188 kPa |
| | | (HTS) | $t_m$ | 120 ms | 99 ms | 86 ms |
| | | | Combustion | Complete Combustion | Complete Combustion | Complete Combustion |
| | | | Slag Emission Amount | 0.89 g | 1.15 g | 1.01 g |
| Compara. | 130 | $MoO_3$ | $P_m$ | 162 kPa | 173 kPa | 225 kPa |
| Example | | (None) | $t_m$ | 79 ms | 68 ms | 43 ms |
| | | | Combustion | Complete Combustion | Complete Combustion | Complete Combustion |
| | | | Slag Emission Amount | 5.61 g | 7.27 g | 8.10 g |

Example 11

Described in the above said Example 7 was that the combustibility of even the explosive compositions using oxohalogen acid salts, which had had difficulties in controlling the combustibility, could be controled by combining with the combustion catalysts mentioned above. Here, description on test examples of the explosive compositions further combined with said combustion catalysts and binders of the present invention will be given. The explosive compositions used in the tests were as follows.

No. 103: The explosive composition of the present invention in which the same $KNO_3$ and $MoO_3$ as Examples 8 and 9 were respectively used as the oxidizing agent and the combustion catalyst, and further HTS was used as the binder;

No. 119: The explosive composition of the present invention in which 37.5 parts by weight of 5ATZ, 53.4 parts by weight of potassium perchlorate of strong oxidative as the oxidizing agent, 4.5 parts by weight of $Fe_2O_3$ as the combustion catalyst and 4.6 parts by weight of HTS as the binder were mixed;

No. 130: The same explosive composition with no binder as used in Examples 9 and 11; and No. 133: The same explosive composition as No. 119 except having no the combustion catalyst of $Fe_2O_3$, which was a Comparative Example.

The above said each explosive composition was press-formed in order to obtain a given formed body of which a height was 8 mm, a width was 5 mm and a length was 50 mm and a weight was about 3.6 g as well as the case of Example 7.

The explosive compositions thus produced were used to determine the combustion velocity in the same testing manner as in Example 4. The results are shown in TABLE 9.

TABLE 9 shows that even when potassium perchlorate ($KClO_4$) of a powerful oxidizing agent was used as the oxidizing agent, the pressure exponent n in Example (No. 119) of the present invention was 0.4, whereas the pressure exponent n in Comparative Example (No. 133) including no combustion agent was 0.6 which was a high for a gas generator. In addition, even when potassium nitrate ($KNO_3$) was used as the oxidizing agent,the pressure components n in Examples (No, 103, 130) containing the combustion catalysts was 0.3 which fell in the range of the pressure exponent of 0.3 to 0.45 regarded as preferable for the gas generator.

This fact indicates that the binders used in the present invention have no effect on the pressure exponent, from which it can be understood that the adjustment of the pressure exponent may be performed via the combustion catalysts.

TABLE 9

(Pressure Exponent Measurement Test Result)

| Test Number | | Fuel ingredient | Combustion Adjustor | Binder | Oxidizing agent | Pressure Exponent (value n) |
|---|---|---|---|---|---|---|
| The Present Invention | 103 | 5ATZ | $MoO_3$ | HTS | $KNO_3$ | 0.3 |
| | 119 | as above | $Fe_2O_3$ | as above | $KClO_4$ | 0.4 |
| Compara. Example | 130 | 5ATZ | $MoO_3$ | None | $KNO_3$ | 0.3 |
| | 133 | as above | None | HTS | $KClO_4$ | 0.6 |

Example 12

Next, description on the thermal aging resistance characteristics provided by the binders and heat-treatments of the present invention will be given. The tablets of No. 103 obtained in Example 8 were heat-treated with various kinds of temperatures and time in order to obtain test tablets (Nos. 140–145). Similarly, the tablets of No. 110 obtained in Example 5 were heat-treated in a similar manner to obtain test tablets (Nos. 150–154).

TABLE 10

(Thermal Aging Resistance Test Result)

| Test Number | Fuel ingredient | Combustion Adjustor and Oxidizing agent | Binder | Heat Treatment Condition (Temp. × Time) | Status of Cover After Thermal Aging Resistance Test | Effect By Heat Treatment *1 |
|---|---|---|---|---|---|---|
| 140 | 5ATZ | $MoO_3$ $KNO_3$ | HTS | None | Container expanded and Cover was broken | × |
| 141 | as above | as above | as above | 90° C. × 2 hrs. | as above | × |
| 142 | as above | as above | as above | 110° C. × 2 hrs. | No change occurred | ○ |
| 143 | as above | as above | as above | 110° C. × 24 hrs. | as above | ○ |
| 144 | as above | as above | as above | 120° C. × 2 hrs. | as above | ○ |
| 145 | as above | as above | as above | 120° C. × 24 hrs. | as above | ○ |
| 150 | 5ATZ-K | $Fe_2O_3$ $KNO_3$ | HTS | None | Container expanded and Cover was broken | × |
| 151 | as above | as above | as above | 110° C. × 2 hrs. | No change occurred | ○ |
| 152 | as above | as above | as above | 110° C. × 24 hrs. | as above | ○ |
| 153 | as above | as above | as above | 120° C. × 2 hrs. | as above | ○ |
| 154 | as above | as above | as above | 120° C. × 24 hrs. | as above | ○ |

*1) ○: Effects were provided.
×: No effects were provided.

30 g of each kind of the tablets was filled in an aluminum container, then, the container was sealed and subjected to the thermal aging resistance test at 107° C. for 400 hours in order to evaluate the effect of the heat treatment by measuring the degree of expansion or breakage of a cover of the aluminum container after the thermal aging resistance test. Here, sealing degree of the cover was designed so as to be broken at the internal pressure of 0.4 kgf/cm$^2$.

The test results are shown in TABLE 10. As apparent from TABLE 10, test numbers 140 and 150 given no heat treatment provided the result that the cover opened after the thermal aging resistance test, whereas test numbers 142–145 and 151–154 heat-treated at 110° C. or more for 2 to 24 hours provided the result that little change was given to the shape of the container after the thermal aging resistance test , so that the remarkable effect was achieved by the heat treatment. In this connection, the tablet heat-treated at 90° C. (No. 141) provided the result that the cover opened as well as the case of giving no heat treatment.

This fact means that the heat treatment enables moisture existing in a row material of the explosive composition to be removed. Consequently, a harmful effect resulting from the presence of the moisture is eliminated. It is therefore appreciated that the heat-treated explosive composition of the present invention has a good aging resistance and maintains its capabilities stably over a long term after they are set in an airbag system of an automobile.

Example 13

Next, description on specific explosive compositions of the present invention will be given. In the above said Examples in which the tetrazoles was used as the fuel ingredient and nitrate was used as the oxidizing agent, presence of the combustion catalyst was preferable, but in the case of using strontium nitrate ($Sr(NO_3)_2$) as the oxidizing agent, the combustion catalyst is not necessary. Accordingly, description on this specific case will be given below.

The fuel ingredient was prepared by a following manner. Atomized silica of 1.0 parts by weight having an 1 $\mu$m or less particle diameter was added to 5ATZ in advance. The 5ATZ mixed with the atomized silica was pulverized, then granules having $^{50}$ $\mu$m or less particle diameter were obtained as the fuel ingredient. The 50% average particle diameter of the reference number was 10 $\mu$m. Then, 5ATZ of 33.0 parts by weight (including atomized silica of 0.33 parts by weight) was used as the fuel ingredient.

The oxidizing agent was prepared by a following manner. Atomized silica of 1.0 parts by weight was added to $Sr(NO_3)_2$ in advance. The $Sr(NO_3)_2$ mixed with the atomized silica was pulverized, then granules having 50 μm or less particle diameter were obtained as the oxidizing agent. The 50% average particle diameter of the reference number was 10 μm. Then, the $Sr(NO_3)_2$ of 62.5 parts by weight (including 0.62 parts by weight atomized silica) was used as the oxidizing agent.

HTS ($Mg6Al_2(OH)_{16}CO_3.4H_2O$) of 4.5 parts by weight was prepared as a binder by pulverizing, then, HTS granules having 50 μm or less particle diameter were obtained. The 50% average particle diameter of the reference number was 10 μm.

The above fuel ingredient, oxidizing agent and HTS were fully mixed together in a Vee-mixer. Then, polyvinyl alcohol (PVA) was sprayed dropwise thereinto by 0.5 parts by weight at outer percentage in order to be mixed. Here, polyvinyl alcohol (PVA) was dissolved in a prescribed amount of demineralized water as a modifier of a formability in advance. And the resulting mixture was formed into granules then heat-treated. After the heat treatment, 0.2 parts by weight, expressed at outer percentage, of zinc stearate (St-Zn) used as the lubricant was added thereto to be mixed. Then, the mixture was press-formed into a tablet form by the rotary type tablet making apparatus in order to obtain tablets of gas generating agents of which diameter was 5 mm, thickness was 2 mm and weight was about 88 mg. The tablets thus obtained were heat-treated at 110° C. for 5 hours. In addition, gas generating agents containing no HTS mentioned above and gas generating agents containing no PVA as the modifier of formability were also formed in the same manner as in the above for comparison purposes.

These gas generating agents were measured in respect of their collapsing strength, abrasiveness and formability of the tablets for comparison. In addition, the slag emission amount was measured via the 60 liter tank test in the same manner as Example 6. Here, the abrasiveness of the tablet was measured in the following manner. 10 g of measured tablets filled in a rotary drum having a free-fall distance of about 150 mm. The rotary drum was rotated 250 times with 25 rpm (for 10 minutes) and then the ratio (%) of the tablet passing through 0.5 mm openings of a screen were taken as the abrasiveness.

The rest results are shown in TABLE 11. TABLE 11 shows that the gas generating agent No. 161 of the present invention containing HTS as the binder, $Sr(NO_3)_2$ as the oxidizing agent, PVA as the modifier of the formability and atomized silica and St-Zn as the lubricant was satisfactory in every respect of collapsing strength, abrasiveness and formability. And the gas generating agent No. 161 also performed a stable combustion and also produced the most reduced slag emission amounts, from which it can be understood that the optimal gas generating agents was produced. Also, the gas generating agent No. 162 of the present invention containing no formability modifier is slightly inferior to in formability but is virtually identical to the above said gas generating agent No. 161 in other points, thus presenting no problem in use.

On the other hand, the gas generating agent of Comparative Example No. 171 containing no binder was not in an available level in collapsing strength as well as slag emission amount. It can be understood from this that the gas generating agents Nos. 161 and 162 of the present invention enable the slag having good scavenging property to be formed by interaction between HTS and strontium nitrate. On the other hand, the gas generating agent of Comparative Example No. 172 containing neither binder nor formability modifier provided a further reduction of collapsing strength leading to further difficulties in formation, from which it can be understood that such is practically of little avail.

TABLE 11

(Test Result On Strength, Abrasiveness, Formability and Slag Scavenging Property)

| Test Number | | Binder/ Formability Modifier/ Lubricant | Strength[a] ($kg/cm^2$) | Abrasiveness (%) | Formability | Slag Emission Amount (g) |
|---|---|---|---|---|---|---|
| The Present Invention | 161 | HTS/PVA/ Atomized Silica + St-Zn | 15.00 | 0.19 | ◎[b] | 1.05 |
| | 162 | HTS/Nil/ Atomized Silica + St-Zn | 14.50 | 0.20 | ○[c] | 1.20 |
| Compara. Example | 171 | Nil/PVA/ Atomized Silica + St-Zn | 8.85 | 0.30 | ◎ | 5.00 |
| | 172 | Nil/Nil/ Atomized Silica + St-Zn | 6.40 | 1.80 | ×[d] | 5.50 |

[a]Measured with Monsant Hardness Meter
[b]No adherence to Rod was found. No breakage of Pellet occurred.
[c]Some adherence to Rod was found. No breakage of Pellet occurred.
[d]Much adherence to Rod was found and breakage of Pellets occurred a lot.

As detailed above, the explosive composition of the present invention can provide the following outstanding effects:

(1) Thermal shock resistance and combustibility of an airbag-use gas generating agent containing organic nitrogen as fuel can be improved by using the hydrotalcite group as the binder.

(2) In the case of selecting the tetrazole group as organic nitrogen, safety which is inherent in a known explosive composition having the tetrazoles as its major ingredients can be maintained, while its disadvantage of low combustibility can be modified by adding a specified combustion catalyst so that its combustibility may be improved. In addition, no harmful combustion gas is produced, thus providing an improved safety airbag.

(3) Also, even in combination of the tetrazole group with a powerful oxidizing agent such as an oxohalogen acid salt, the pressure exponent n can be reduced and the combustibility can be easily controled by presence of a specified combustion catalyst, so that a design of a gas generator can be facilitated.

(4) Even in combination of the tetrazole group with the oxidizing agents of low combustibility such as nitrates or nitrites of alkali metals, alkali earth metals or ammonium, the combustibility can be improved and stabilized by presence of a specified combustion catalyst so as to burn the explosive compositions completely, so that a design of a gas generator can be facilitated. Also, the combustion gas of low NOx can be obtained by reduction of the combustion temperature which is inherent in these oxidizing agents.

(5) Even in combination of the tetrazole group with nitrates or nitrites of alkali metals or alkali earth metals, the combustion slag formation can be promoted by using the binders of the present invention so as to form a easily filterable slag. As a result, not only a design of a filter part of the gas generator can be facilitated for the design of the gas generator but also a clean gas can be produced in the airbag system.

(6) With combination of tetrazole group as the fuel ingredient, strontium nitrate as the oxidizing agent and hydrotalcite group as the binder, the gas generating agents satisfactory in combustion as well as in slag scavenging property can be provided under non-presence of the above said combustion catalyst.

(7) Since the explosive composition of the present invention is usable not only as the gas generating agent but also as the enhancer. Therefore, only one kind of explosive composition is simply required to be produced, instead of two kinds of explosive compositions which have been produced in separate processes respectively. This contributes to reduction of a risk in the production process and thus provides a great advantage for a production site of explosive devices involving dangerous works. Further, viewed from an aspect of production of the gas generator, since the same compositions as those of the gas generating agents of an overwhelmingly large amounts can be used as the enhancers, the need for producing a small amount of enhancers can be eliminated to contribute to cost reduction.

(8) Further, by giving a specific heat treatment to the explosive composition of the present invention after formed, its stable property can be maintained for a long term.

Capabilities of Exploitation in Industry

As mentioned above, the explosive composition of the present invention is usable not only as the airbag gas generating agent but also as the enhancer, and especially useful as the airbag explosive composition safe in production process.

We claim:

1. An airbag explosive composition, comprising:

(a) a fuel selected from the group consisting of (i) 5-aminotetrazole, (ii) an alkali metal salt of 5-aminotetrazole and (iii) an alkaline earth metal salt of 5-aminotetrazole;

(b) an oxidizing agent for the combustion of said fuel; and (c) a hydrotalcite binder for ingredients (a) and (b) having the formula:

$$[M^{2+}_{1-x}M^{3+}_{x}(OH)_2]^{x+}[A^{n-}_{x/n}.mH_2O]^{x-}$$

wherein $M^{2+}$ is a bivalent metal ion;

$M^{3+}$ is a trivalent metal ion;

$A^{n-}$ is an n-valent anion; and $0<x\leqq 0.33$ and m is a positive integer.

2. The composition as set forth in claim 1, wherein said bivalent metal ion $M^{2+}$ is selected from the group consisting of $Mg^{2+}$, $Mn^{2-,\ Fe2+}$, $Co^{2+}$, $Ni^{2+}$, $Cu^{2+}$ and $Zn^{2+}$, said trivalent metal ion $M^{3+}$ is selected from the group consisting of $Al^{3+}$, $Fe^{3+}$, $Cr^{2+}$, $Co^{3+}$ and $In^{3+}$ and said n-valent anion is a member selected from the group consisting of $OH^{-,\ F-}$, $Cl^-$, $NO^{3-}$, $CO_3^{2-}$, $SO_4^{2-}$, $Fe(CN)_6^{3-}$, $CH_3COO^-$, oxalate ion and salicylate ion.

3. The composition as set forth in claim 1, wherein said hydrotalcite is a hydrotalcite of the formula: $Mg_6Al_2(OH)_{16}CO_3.4H_2O$ or pyroaurite of the formula: $Mg_6Fe_2(OH)_{16}CO_3.4H_2O$.

4. The composition as set forth in claim 3, wherein the amount of said hydrotalcite in the composition is 2–30% by weight.

5. The composition as set forth in claim 4, wherein the amount of said hydrotalcite in the composition is 3–10% by weight.

6. The composition as set forth in claim 3, wherein the 50% average particle diameter of a reference number of particles of said hydrotalcite is 30 $\mu$m or less.

7. The composition as set forth in claim 1, wherein the 50% average particle diameter of a reference number of said fuel is 5–80 $\mu$m.

8. The composition as set forth in claim 1, wherein said oxidizing agent is at least one nitrate or nitrite of an alkali metal ion, an alkaline earth metal ion or ammonium ion.

9. The composition as set forth in claim 1, wherein said oxidizing agent is a mixture of an oxohalogen acid salt and at least one nitrate or nitrite of an alkali metal ion, an alkaline earth metal ion or an ammonium ion.

10. The composition as set forth in claim 1, wherein said oxidizing agent is strontium nitrate.

11. The composition as set forth in claim 8, wherein the 50% average particle diameter of a reference number of particles of said oxidizing agent is 5–80 $\mu$m.

12. The composition as set forth in claim 1, wherein said explosive composition comprises at least one combustion catalyst selected from the group consisting of components (d) and (e), wherein:

(d) is at least one metal selected from the group consisting of zirconium, hafnium, molybdenum, tungsten, manganese, nickel or iron or an oxide or sulfide thereof; and (e) is at least one member selected from the group consisting of carbon, sulfur and phosphorus.

13. The composition as set forth in claim 12, wherein the amount of said combustion catalyst is 10% by weight or less.

14. The composition as set forth in claim 13, wherein the amount of said combustion catalyst is 2–8% by weight.

15. The composition as set forth in claim 12, wherein the 50% average particle diameter of a reference number of particles of said combustion catalyst is 10 $\mu$m or less.

16. The composition as set forth in claim 1, wherein a water-soluble polymer as a formability modifier is added to the composition.

17. The composition as set forth in claim 16, wherein said water-soluble polymer is at least one member selected from the group consisting of polyethylene glycol, polypropylene glycol, polyvinyl ether, polymaleic copolymer, polyethyleneimide, polyvinyl alcohol, polyvinyl pyrrolidone, polyacrylamide, sodium polyacrylate and ammonium polyacrylate.

18. The composition as set forth in claim 17, wherein said water-soluble polymer is polyvinyl alcohol which is present in the composition in an amount of 0.01–0.5% by weight.

19. The composition as set forth in claim 1, wherein a lubricant is added to the composition and then the composition is shaped.

20. The composition as set forth in claim 19, wherein said lubricant is at least one material selected from the group consisting of stearic acid, zinc stearate, magnesium stearate, calcium stearate, aluminum stearate, molybdenum disulfide, graphite, atomized silica and boron nitride.

21. The composition as set forth in claim 1, wherein the explosive composition is shaped into tablets or disk-like objects.

22. The composition as set forth in claim 1, wherein said composition is an enhancer for an airbag.

23. The composition as set forth in claim 22, wherein said explosive composition is shaped into granules of a diameter of 1.0 mm or less.

24. The composition as set forth in claim 23, wherein said explosive composition is heat-treated at 100–120° C. for 2–24 hours after being shaped into a granular shape.

25. A method of preparing an airbag explosive composition, comprising:

mixing (a) a fuel selected from the group consisting of (i) 5-aminotetrazole, (ii) an alkali metal salt of 5-aminotetrazole and (iii) an alkaline earth metal salt of 5-aminotetrazole;

(b) an oxidizing agent for the combustion of said fuel; and (c) a hydrotalcite binder for ingredients (a) and (b) having the formula:

$$[M^{2+}_{1-x}M^{3+}_{x}(OH)_2]^{x+}[A^{n-}_{x/n}.mH_2O]^{x-}$$

wherein $M^{2+}$ is a bivalent metal ion;

$M^{3+}$ is a trivalent metal ion;

$A^{n-}$ is an n-valent anion; and $0<x\leqq 0.33$ and m is a positive integer;

shaping the mixture into a given shape; and thereafter heat-treating the shaped mixture at 100–120° C. for 2–24 hours.

26. The composition as set forth in claim 25, wherein said bivalent metal ion $M^{2+}$ is selected from the group consisting of $Mg^{2+}$, $Mn^{2-}$, $Fe^{2+}$, $Co^{2+}$, $Ni^{2+}$, $Cu^{2+}$ and $Zn^{2+}$, said trivalent metal ion $M^{3+}$ is selected from the group consisting of $Al^{3+}$, $Fe^{3+}$, $Cr^{2+}$, $Co^{3+}$ and $In^{3+}$ and said n-valent anion is a member selected from the group consisting of $OH^-$, $F^-$, $Cl^-$, $NO^{3-}$, $CO_3^{2-}$, $SO_4^{2-}$, $Fe(CN)_6^{3-}$, $CH_3COO^-$, oxalate ion and salicylate ion.

27. The method of claim 25, wherein said hydrotalcite binder consists of hydrotalcite having the formula: $Mg_6Al_2(OH)_{16}CO_3.4H_2O$ or pyroaurite having the formula: $Mg_6Fe_2(OH)_{16}CO_3.4H_2O$.

28. A method of preparing an airbag explosive composition, comprising:

mixing the following ingredients (a)–(d):

(a) a fuel selected from the group consisting of (1) 5-aminotetrazole, (2) an alkali metal salt of 5-aminotetrazole and (3) an alkaline earth metal salt of 5-aminotetrazole;

(b) an oxidizing agent for the combustion of said fuel; and (d) at least one combustion catalyst selected from the group consisting of (i) and (ii) which regulate the oxidation reaction:

(i) is at least one metal selected from the group consisting of zirconium, hafnium, molybdenum, tungsten, manganese, nickel or iron or an oxide or sulfide thereof; and (ii) at least one of carbon, sulfur or phosphorus, and (c) a hydrotalcite binder for ingredients (a), (b) and (d) having the formula:

$$[M^{2+}_{1-x}M^{3+}_{x}(OH)_2]^{x+}[A^{n-}_{x/n}.mH_2O]^{x-}$$

wherein $M^{2+}$ is a bivalent metal ion;

$M^{3+}$ is a trivalent metal ion;

$A^{n-}$ is an n-valent anion; and $0<x\leqq 0.33$ and m is a positive integer;

shaping the mixture into a given shape; and thereafter heat-treating the shaped mixture at 100–120° C. for 2–24 hours.

29. The composition as set forth in claim 28, wherein said bivalent metal ion $M^{2+}$ is selected from the group consisting of $Mg^{2+}$, $Mn^{2-}$, $Fe^{2+}$, $Co^{2+}$, $Ni^{2+}$, $Cu^{2+}$ and $Zn^{2+}$, said trivalent metal ion $M^{3+}$ is selected from the group consisting of $Al^{3+}$, $Fe^{3+}$, $Cr^{2+}$, $Co^{3+}$ and $In^{3+}$ and said n-valent anion is a member selected from the group consisting of $OH^-$, $F^-$, $Cl^-$, $NO^{3-}$, $CO_3^{2-}$, $SO_4^{2-}$, $Fe(CN)_6^{3-}$, $CH_3COO^-$, oxalate ion and salicylate ion.

30. The method of claim 28, wherein said hydrotalcite binder consists of hydrotalcite having the formula: $Mg_6Al_2(OH)_{16}CO_3.4H_2O$ or pyroaurite having the formula: $Mg_6Fe_2(OH)_{16}CO_3.4H_2O$.

31. The method of claim 25, wherein the 50% average particle diameter of a reference number of particles of said fuel is 5–80 μm; the 50% average particle diameter of a reference number of particles of said oxidizing agent is 5–80 μm; and a 50% the average particle diameter of a reference number of particles of said binder is 30 μm or less.

32. The method of claim 28, wherein the 50% average particle diameter of a reference number of particles of said fuel is 5–80 μm; the 50% average particle diameter of a reference number of particles of said oxidizing agent is 5–80 μm; the 50% average particle diameter of a reference number of particles of said combustion catalyst is 10 μm or less; and the average particle diameter of 50% of the particles of said binder is 30 μm or less.

33. An airbag explosive composition, comprising:

(a) a fuel which is an organic compound containing a plurality of nitrogen atoms;

(b) an oxidizing agent for the combustion of said nitrogen containing fuel; and (c) a hydrotalcite binder for ingredients (a) and (b) having the formula:

$$[M^{2+}_{1-x}M^{3+}_{x}(OH)_2]^{x+}[A^{n-}_{x/n}.mH_2O]^{x-}$$

wherein $M^{2+}$ is a bivalent metal ion;

$M^{3+}$ is a trivalent metal ion;

$A^{n-}$ is an n-valent anion; and $0<x\leqq 0.33$ and m is a positive integer.

* * * * *

UNITED STATES PATENT AND TRADEMARK OFFICE

CERTIFICATE OF CORRECTION

PATENT NO. : 6,033,500

DATED : March 7, 2000

INVENTOR(S): Yuji ITO et al.

It is certified that an error appears in the above-identified patent and that said Letters Patent is hereby corrected as shown below:

On the title page, item [73], the 2nd Assignee's city is misspelled. The Assignees should read as follows:

--[73] Assignees: Sensor Technology Co., Ltd., Kobe; Nippon Kayaku Kabushiki-Kaisha, Tokyo, both of Japan--

Signed and Sealed this

Tenth Day of April, 2001

*Attest:*

Nicholas P. Godici

NICHOLAS P. GODICI

*Attesting Officer*

*Acting Director of the United States Patent and Trademark Office*